US008643296B2

(12) United States Patent
Bazzani et al.

(10) Patent No.: US 8,643,296 B2
(45) Date of Patent: Feb. 4, 2014

(54) COLOR MIXING AND DESATURATION WITH REDUCED NUMBER OF CONVERTERS

(75) Inventors: Cristiano Bazzani, Irvine, CA (US); Fabio Gozzini, Newport Beach, CA (US); Steven Van Nguyen, Garden Grove, CA (US)

(73) Assignee: Mindspeed Technologies, Inc., Newport Beach, CA (US)

( * ) Notice: Subject to any disclaimer, the term of this patent is extended or adjusted under 35 U.S.C. 154(b) by 146 days.

(21) Appl. No.: 13/302,991

(22) Filed: Nov. 22, 2011

(65) Prior Publication Data

US 2012/0133300 A1 May 31, 2012

Related U.S. Application Data

(60) Provisional application No. 61/458,443, filed on Nov. 22, 2010, provisional application No. 61/517,906, filed on Apr. 26, 2011.

(51) Int. Cl.
*H05B 37/02* (2006.01)

(52) U.S. Cl.
USPC ..... 315/209 R; 315/192; 315/210

(58) Field of Classification Search
USPC ..... 315/209 R, 192, 217, 210, 317, 297, 307
See application file for complete search history.

(56) References Cited

U.S. PATENT DOCUMENTS 4,534,064 A 8/1985 Giacometti et al.
4,545,078 A 10/1985 Wiedeburg
4,687,924 A 8/1987 Galvin et al.
4,734,914 A 3/1988 Yoshikawa
4,747,091 A 5/1988 Doi
4,864,649 A 9/1989 Tajima et al.
5,019,769 A 5/1991 Levinson
5,039,194 A 8/1991 Block et al.

(Continued)

FOREIGN PATENT DOCUMENTS

EP 1471671 12/2004
JP 2004045989 2/2004

(Continued)

OTHER PUBLICATIONS

Jamie Bailey "How DVD Works", http://sweb.uky.edu/~jrbai101/dvd.htm, May 1, 1999, pages.

(Continued)

*Primary Examiner* — Daniel D Chang
(74) *Attorney, Agent, or Firm* — Weide & Miller, Ltd.

(57) ABSTRACT

A system is disclosed to automatically establish proper biasing for light sources in a color mixed projection system having multiple light sources which are active at the same time. Responsive to a feedback signal, a single DC-DC converter generates the bias voltage for the light sources. Comparators compare a headroom signal for each light source to a reference value to generate comparator output signals. The comparator output signals are processed by a channel selector and a digital filter/DAC module. The channel selector controls a switch to selectively provide and combine a headroom signal with an output of the digital filter/DAC module to create the feedback signal. By monitoring each headroom value, the bias voltage is adjusted, based on the feedback signal, until every headroom signal reaches the reference value thereby achieving sufficient biasing for every active light source in the color mixed projection system.

22 Claims, 12 Drawing Sheets

(56) References Cited

U.S. PATENT DOCUMENTS

| | | | |
|---|---|---|---|
| 5,047,835 | A | 9/1991 | Chang |
| 5,057,932 | A | 10/1991 | Lang |
| 5,334,826 | A | 8/1994 | Sato et al. |
| 5,383,046 | A | 1/1995 | Tomofuji et al. |
| 5,383,208 | A | 1/1995 | Queniat et al. |
| 5,392,273 | A | 2/1995 | Masaki et al. |
| 5,394,416 | A | 2/1995 | Ries |
| 5,396,059 | A | 3/1995 | Yeates |
| 5,448,629 | A | 9/1995 | Bosch et al. |
| 5,488,627 | A | 1/1996 | Hardin et al. |
| 5,510,924 | A | 4/1996 | Terui et al. |
| 5,557,437 | A | 9/1996 | Sakai et al. |
| 5,574,435 | A | 11/1996 | Mochizuki et al. |
| 5,594,748 | A | 1/1997 | Jabr |
| 5,636,254 | A | 6/1997 | Hase et al. |
| 5,673,282 | A | 9/1997 | Wurst |
| 5,812,572 | A | 9/1998 | King et al. |
| 5,822,099 | A | 10/1998 | Takamatsu |
| 5,844,928 | A | 12/1998 | Shastri et al. |
| 5,900,959 | A | 5/1999 | Noda et al. |
| 5,926,303 | A | 7/1999 | Giebel et al. |
| 5,943,152 | A | 8/1999 | Mizrahi et al. |
| 5,953,690 | A | 9/1999 | Lemon et al. |
| 5,956,168 | A | 9/1999 | Levinson et al. |
| 5,978,393 | A | 11/1999 | Feldman et al. |
| 6,010,538 | A | 1/2000 | Sun et al. |
| 6,014,241 | A | 1/2000 | Winter et al. |
| 6,020,593 | A | 2/2000 | Chow et al. |
| 6,021,947 | A | 2/2000 | Swartz |
| 6,023,147 | A | 2/2000 | Cargin, Jr. et al. |
| 6,049,413 | A | 4/2000 | Taylor et al. |
| 6,064,501 | A | 5/2000 | Roberts et al. |
| 6,108,113 | A | 8/2000 | Fee |
| 6,111,687 | A | 8/2000 | Tammela |
| 6,115,113 | A | 9/2000 | Flockencier |
| H1881 | H | 10/2000 | Davis et al. |
| 6,160,647 | A | 12/2000 | Gilliland et al. |
| 6,175,434 | B1 | 1/2001 | Feng |
| 6,259,293 | B1 | 7/2001 | Hayase et al. |
| 6,262,781 | B1 | 7/2001 | Deter |
| 6,282,017 | B1 | 8/2001 | Kinoshita |
| 6,292,497 | B1 | 9/2001 | Nakano |
| 6,366,373 | B1 | 4/2002 | MacKinnon et al. |
| 6,423,963 | B1 | 7/2002 | Wu |
| 6,452,719 | B2 | 9/2002 | Kinoshita |
| 6,473,224 | B2 | 10/2002 | Dugan et al. |
| 6,494,370 | B1 | 12/2002 | Sanchez |
| 6,512,617 | B1 | 1/2003 | Tanji et al. |
| 6,535,187 | B1 | 3/2003 | Wood |
| 6,556,601 | B2 | 4/2003 | Nagata |
| 6,570,944 | B2 | 5/2003 | Best et al. |
| 6,580,328 | B2 | 6/2003 | Tan et al. |
| 6,661,940 | B2 | 12/2003 | Kim |
| 6,704,008 | B2 | 3/2004 | Naito et al. |
| 6,707,600 | B1 | 3/2004 | Dijaili et al. |
| 6,740,864 | B1 | 5/2004 | Dries |
| 6,801,555 | B1 | 10/2004 | Dijaili et al. |
| 6,836,493 | B2 | 12/2004 | Mahowald et al. |
| 6,837,625 | B2 | 1/2005 | Schott et al. |
| 6,852,966 | B1 | 2/2005 | Douma et al. |
| 6,862,047 | B2 | 3/2005 | Hibi |
| 6,868,104 | B2 | 3/2005 | Stewart et al. |
| 6,888,123 | B2 | 5/2005 | Douma et al. |
| 6,909,731 | B2 | 6/2005 | Lu |
| 6,934,307 | B2 | 8/2005 | DeCusatis et al. |
| 6,934,479 | B2 | 8/2005 | Sakamoto et al. |
| 6,941,077 | B2 | 9/2005 | Aronson et al. |
| 6,952,531 | B2 | 10/2005 | Aronson et al. |
| 6,956,643 | B2 | 10/2005 | Farr et al. |
| 6,957,021 | B2 | 10/2005 | Aronson et al. |
| 6,967,320 | B2 | 11/2005 | Chieng et al. |
| 7,031,574 | B2 | 4/2006 | Huang et al. |
| 7,039,082 | B2 | 5/2006 | Stewart et al. |
| 7,046,721 | B2 | 5/2006 | Grohn |
| 7,049,759 | B2 | 5/2006 | Roach |
| 7,050,720 | B2 | 5/2006 | Aronson et al. |
| 7,058,310 | B2 | 6/2006 | Aronson et al. |
| 7,066,746 | B1 | 6/2006 | Togami et al. |
| 7,079,775 | B2 | 7/2006 | Aronson et al. |
| 7,184,671 | B2 | 2/2007 | Wang |
| 7,193,957 | B2 | 3/2007 | Masui et al. |
| 7,206,023 | B2 | 4/2007 | Belliveau |
| 7,215,891 | B1 | 5/2007 | Chiang et al. |
| 7,265,334 | B2 | 9/2007 | Draper et al. |
| 7,276,682 | B2 | 10/2007 | Draper et al. |
| 7,357,513 | B2 | 4/2008 | Watson et al. |
| 7,381,935 | B2 | 6/2008 | Sada et al. |
| 7,453,475 | B2 | 11/2008 | Nitta et al. |
| 7,504,610 | B2 | 3/2009 | Draper |
| 7,692,417 | B2 | 4/2010 | Dagher |
| 2001/0046243 | A1 | 11/2001 | Schie |
| 2002/0015305 | A1 | 2/2002 | Bornhorst et al. |
| 2002/0105982 | A1 | 8/2002 | Chin et al. |
| 2002/0130977 | A1 | 9/2002 | Hibi |
| 2003/0030756 | A1 | 2/2003 | Kane et al. |
| 2003/0053003 | A1 | 3/2003 | Nishi et al. |
| 2004/0032890 | A1 | 2/2004 | Murata |
| 2004/0047635 | A1 | 3/2004 | Aronson et al. |
| 2004/0136727 | A1 | 7/2004 | Androni et al. |
| 2004/0202215 | A1 | 10/2004 | Fairgrieve |
| 2005/0180280 | A1 | 8/2005 | Hoshino et al. |
| 2005/0185149 | A1 | 8/2005 | Lurkens et al. |
| 2005/0215090 | A1 | 9/2005 | Harwood |
| 2006/0192899 | A1 | 8/2006 | Ogita |
| 2007/0058089 | A1 | 3/2007 | Wang |
| 2007/0081130 | A1 | 4/2007 | May et al. |
| 2007/0114951 | A1* | 5/2007 | Tsen et al. ..... 315/291 |
| 2007/0195208 | A1 | 8/2007 | Miyazawa et al. |
| 2007/0229718 | A1 | 10/2007 | Hall |
| 2007/0286609 | A1 | 12/2007 | Ikram et al. |
| 2008/0024469 | A1 | 1/2008 | Damera-Venkata et al. |
| 2008/0074562 | A1 | 3/2008 | Endo et al. |
| 2008/0246893 | A1 | 10/2008 | Boss et al. |
| 2008/0303499 | A1 | 12/2008 | Chen et al. |
| 2012/0181939 | A1* | 7/2012 | Szczeszynski et al. ..... 315/186 |

FOREIGN PATENT DOCUMENTS

| | | |
|---|---|---|
| WO | WO 93/21706 | 10/1993 |
| WO | WO 02/063800 | 8/2002 |
| WO | WO 2004/098100 | 11/2004 |

OTHER PUBLICATIONS

Tuan "Solace" Nguyen, "CD, CD-R, CD-RW, DVD, DD-RAM, DVD-RW, and MO", Tweak3D.Net—Your Freakin' Tweakin Source!, http://www.tweak3d.net/articles/opticals/, May 13, 2000, 7 pages.

"An Introduction to DVD-RW", DVD White Paper, Pioneer New Media Technologies, Inc., Feb. 8, 2001, 8 pages.

Richard Wilkinson "Topic: Selecting the Right DVD Mastering Technique", DVD Technology Update, http://www.optical-disc.com/dvdupdate.html, 2002, 8 pages.

Dr. John Rilum, "Mastering Beyond DVD Density", http://www.optical-disc.com/beyonddvd.html, 2002, 7 pages.

"CD Basics: The Bumps", Howstuffworks "How CD Burners Work", http://entertainment.howstuffworks.com/cd-burner1.htm, 2004, 3 pages.

Keith Szolusha, "Linear Technology Design Notes DC/DC Converter Drives Lumileds White LEDs from a Variety of Power Sources-Design Note 340", Linear Technology Corporation, © Linear Technology Corporation 2004, date unknown, 2 pages.

"An Introduction to DVD Recordable (DVD-R) What is DVD Recordable?" http://www.dvd-copy.com/reference/dvd_recordable.html, 2004, 8 pages.

(56) References Cited

OTHER PUBLICATIONS

"Power Management, LED—driver considerations" Analog and Mixed-Signal Products, Analog Applications Journal, www.ti.com/sc/analogapps, Texas Instruments Incorporated, © 2005 Texas Instruments Incorporated, Michael Day, 5 pages.

"Linear Technology LCT 3533 2A Wide Input Voltage Synchronous Buck-Boost DC/DC Converter", © Linear Technology Corporation 2007, 16 pages.

"National Semiconductor LM 3549 High Power Sequential LED Driver", © 2010 National Semiconductor Corporation, www.national.com, Aug. 3, 2010, 20 pages.

"TPS63020 TPS63021 High Efficiency Single Inductor Buck-Boost Converter With 4-A Switches", Texas Instruments, Copyright © 2010, Texas Instruments Incorporated, Apr. 2010, 28 pages.

* cited by examiner

COLOR MIXING AND DESATURATION WITH REDUCED NUMBER OF CONVERTERS

PRIORITY CLAIM

This application claims priority to and the benefit of Provisional Patent Application 61/458,443 filed Nov. 22, 2010 entitled Color Mixing With Single Converter and Provisional Patent Application 61/517,906 filed Apr. 26, 2011 entitled Color Mixing and Desaturation With Single Converter.

FIELD OF THE INVENTION

This invention relates to projection systems and in particular to a method and apparatus for color mixing and desaturation with single converter or fewer converters than light sources.

RELATED ART

In color sequential projection systems the image is composed with overlapping monochromatic images (usually RED, GREEN and BLUE generated by 3 separate light sources, typically LEDs or lasers). In a system using light sources of three colors, each color source may be on for only a portion (such as ⅓) or subframe of the entire image frame. The projection of each subframe occurs at fast enough rate that the observer sees a smooth or blended image.

The light source may also be a white LED followed in the optical path by a color wheel however this is less common in portable systems due to the size and the potential unreliability of the color wheel. It is more common that the projected image be obtained or created by shining the light onto the pixilation engine (for example a liquid crystal on silicon (LCoS), liquid crystal display (LCD), or digital light processing or projector (DLP) matrix) at a frequency higher then the speed of the human eye in such a way that the still image appears as a single uniform image, and the movement in a video image masks any possible the transitions between colors. Often the color saturation obtained with overlapping images is higher then what is required by the application or what the video source is capable of offering so to increase overall brightness, color mixing or color de-saturation is used where each of the overlapped images in not purely monochromatic (single monochromatic light source on) but instead a primary color is present and other are "mixed-in" by turning on one or more additional light source of different colors.

In a battery operated system or in general in systems where power dissipation is important, usually the voltage across the light source is regulated by a DC-DC converter so that the current required for the specific light output flows into the light source, such as a laser, light emitting diode (LED), or traditional bulb, at the minimum possible voltage required by the light source for that particular current (brightness level) therefore minimizing overall power dissipation.

When color mixing is used, since more then one light source is enabled, multiple DC-DC converters are required to operate each of the light sources at optimal power dissipation level. However, utilizing multiple DC-DC converters makes the system expensive and requires more board space. In addition, each DC-DC converter has a standby power dissipation which adds to the overall power dissipation and thus reduces efficiency. The use of multiple DC-DC converters (one for each light source), allows the system to be more efficient since each light source is operated at its optimal voltage drop.

However the presence of this standby power dissipation reduces the benefit of using multiple DC-DC converters. In addition, the power advantage and usage of multiple DC-DC converter will change depending on drive current, light source (laser/LED) drop (i.e. power dissipated in each light source) and each DC-DC converter's power dissipation.

Likewise, use of multiple DC-DC converters consumes excessive area which is at a premium, particularly in portable devices. Hence, the use of multiple converters is undesirable. The method and apparatus disclosed herein overcomes the drawbacks of the prior art, allows system integrator degrees of freedom in adjusting brightness verses power dissipation verses board area and cost and provides additional benefits.

SUMMARY

To overcome the drawbacks of the prior art and provide additional benefits, a light source bias control system with a single converter is disclosed. In one embodiment the system comprises a first light source having an associated first headroom value on a first terminal and a second light source having an associated second headroom value on a second terminal. One converter is part of this system and is configured to bias the first light source and the second light source. It is contemplated that additional light sources and converters may be utilized, but that a fewer number of converters are provided than the number of light sources. Also part of this embodiment is a switch that is responsive to a switch control signal. The switch is configured to establish a first feedback path between the first terminal and the converter and a second feedback path between the second terminal and the converter. At least one comparator is provided and configured to receive and compare the first headroom value to a first reference value to generate a first comparator output. The comparator also receives and compares the second headroom value to a second reference value to generate a second comparator output. Control logic is also part of this embodiment and is configured to process the first comparator output and the second comparator output to generate the switch control signal.

In one embodiment the first light source and the second light source comprise light emitting diodes. In one embodiment the control logic comprises a state machine and the converter comprises a DC-DC converter. This system may further comprise an analog feedback loop between the switch and converter. In addition, the system may further comprise a digital filter and digital to analog converter between the switch and the converter.

Also disclosed is a method for biasing two or more light sources. This method generates a bias signal with a bias signal generator and provides the bias signal having a first magnitude from a bias signal generator to a first light source and a second light source which establishes a first light source cathode voltage and a second light source cathode voltage. Then, comparing the first light source cathode voltage to the second light source cathode voltage or to a reference voltage. Responsive to this comparing, generating one or more switch control signals and providing the switch control signals to a switch which in turn presents the bias signal generator with a feedback signal or a proportional representation of the feedback signal. Then, responsive to the feedback signal or a proportional representation of the feedback signal, generating a bias signal having a second magnitude different the first magnitude with the bias signal generator.

In this method the bias signal having a second magnitude corresponds to a biasing level for the light source having the highest threshold voltage. The feedback signal may comprise a cathode voltage. In one embodiment the smaller of the first light source cathode voltage and the second light source cathode voltage is output from the switch. This method such that comparing the first light source cathode voltage to the second light source cathode voltage or to a reference voltage generates comparator outputs and the method further comprises processing the comparator outputs with a digital filter to generate a digital feedback signal, converting the digital feedback signal to an analog feedback signal, and presenting the analog feedback signal to the bias signal generator.

Also disclosed is a system having two or more light sources configured to generate a color mixed optical signal output comprising one or more bias signal sources configured to generate a bias signal, the bias signal set by a feedback signal there being a fewer number of bias signal sources than light sources.

As part of this embodiment are also two or more channels such that each channel comprises a light source having a bias set by the bias signal and a light source headroom value associated with each light source. A driver is connected to the light source which is responsive to a control signal to establish a current through the light source to generate an optical output signal, and a comparator is provided and configured to compare the headroom value to a reference value to generate a comparator output. A controller is provided and configured to receive the comparator output from one or more channels to generate feedback signal to the one or more bias sources.

In one embodiment the controller comprises a digital filter configured to receive the comparator output for at least two channels and generate a digital code. A digital to analog converter is configured to convert the digital code to an analog signal which establishes the feedback signal. The digital filter may comprise an up-down counter configured to generate an output that increases in response to a high logic value and decreases in response to a low logic value. In this embodiment, the comparator output is high if the headroom value is greater than the reference value. The headroom value comprises the difference between the bias signal and the turn on voltage for the light source. In one embodiment the controller comprises a channel selector and a switch such that channel selector generates a switch control signal to control the switch to provide one of the light source headroom values or a signal proportional to one of the light source headroom signals to the bias signal generator as the feedback signal. The channel selector may comprise control logic, a state machine, or both. The system may further comprise an analog feedback loop between the controller and at least one bias signal source.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION

In certain embodiments, projection systems may be provided which project an optic image or video which are battery operated and thus is important for the projection system to minimize power consumption. Even devices which plug into a wall or automotive outlet regard reduced power consumption as a benefit. It is also preferred to have an image or video with high image quality including brightness and saturation. In some systems two or more light sources are utilized and these two or more light sources may be utilized concurrently to increase brightness. This is known as color mixing or desaturation. To effectively trade-off power consumption and cost, a single converter or voltage supply, which may be a DC-DC converter, is utilized. To minimize power consumption while providing reliable operation, the biasing of the diodes is set to the minimum voltage required to insure operation. However, different diodes may require different bias voltages, and these values may vary over time and with different frames and subframes. When multiple light sources are active at the same time, the biasing requirements must be maintained to achieve desired operation.

When color mixing or when in desaturation mode, multiple light sources or diodes are on at the same time. For example, although typically only one light source is on at time in a time multiplexed manner, to increase brightness and improve image quality, more than one light source may be on at a time. For example, of the red light source is on at full power for the time period (subframe) assigned to the red color channel, the other one or two diodes D1, D2 (green, blue) may be on to supplement the light output. For example, the red light source may be on at 100% intensity, the green and blue light sources may only be on at 15% intensity. These values may dynamically change during operation across sub-frames and according to changing image brightness levels. Although the color of the light output from these diodes may be different, if not on at full intensity, the perceived image quality will not suffer since in many instances, image brightness is as important as color separation. As can be appreciated, since each light source, such as a diode, has a different biasing requirements, special attention must be provided to insure each light source when in color mixing mode is sufficiently biased with a bias voltage or bias current to enable light output.

Continually maintaining too high a bias voltage wastes power resources, increases heat output, and decreases battery life. Thus, it is desired in all embodiments disclosed herein that the bias voltage (supply voltage) be set sufficiently high to enable operation of all the light sources which are 'on' according to a driver control signal for a particular frame or subframe, while at the same time not establishing the bias voltage at a level which wastes power and reduces efficiency.

Figure 1:
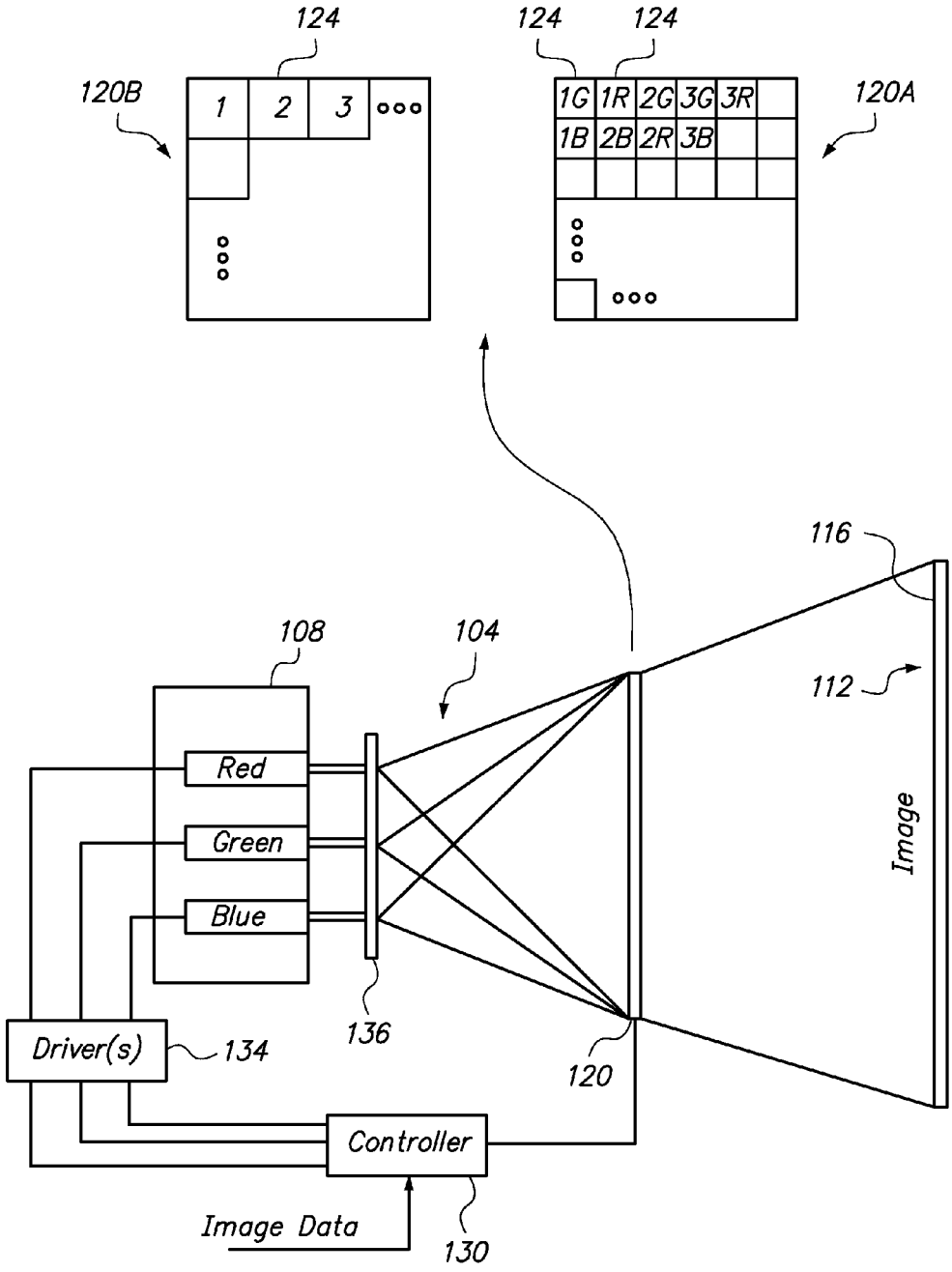
FIG. 1 illustrates an example environment of use of the innovation disclosed herein.

FIG. 1 illustrates an example environment of use of the innovation disclosed herein. This projection system is but one possible environment of use. It is also contemplated that the innovation may be used in any other environment which would benefit from the features set forth herein. Alternative environments of use include but are not limited to laser printers, optical disk writers, range finders or any other application having light sources bias system, such as a DC-DC converter, that must be dynamically adjusted to meet the needs or demands of one or more light sources. This innovation may be of particular benefit when color mixing, which is the activation of more than one light source at a time to increase brightness.

In this example environment of a projector system, a light signal 104 is generated by three light sources 108, such as a red light source, green light source and blue light source. In other embodiments, a different number of light sources may be utilized. The light sources 108 may comprise a laser, LED, or any other light source. The output of the light sources is provided to an optical system 136. In this embodiment, the optical system 136 comprises one or more lenses, minors, or both. The optical system 136 directs or focuses the light to a pixel matrix 120. The optical system 136 may be passive or active. The image 112 is created by shining on and filtering these colors through the pixel matrix 120. In one embodiment, the pixel matrix 120 is an LCD/LCoS system. In other embodiments it can be a DLP engine or any other arrangement or technology. The pixel matrix 120 is a matrix of pixels 124 where each pixel can be made transparent or opaque to light, or some level of opaqueness between transparent and opaque. The projected image 112 is created by shining through or blocking (selectively for each pixel) the light from the light sources 108. The resulting image 112 may be projected onto a viewing screen 116. Multiple pixel matrixes (LCD/LCoS screens) may also be used in some embodiments (for example one per color). It is also understood that the opaqueness or brightness of a pixel can be achieved or through reflection or deflection of all or a portion of the light. In this situation pixel screen or pixilation engine is not transmitting light but is instead reflecting light. Many embodiments of DLP and LCoS systems operate based on this principle. In one embodiment micromirrors are used to reflect or deflect the light.

A controller 130 provides control signals or low power output to one or more drivers 134. The drivers 134 in this example environment of use may benefit from the current driver configuration and control algorithms shown and discussed below. The one or more drivers 134 amplify the signal(s) from the controller 130 to a level suitable to power the light sources 108. In one embodiment the drivers 134 and controller 130 (or processor) are combined into a single integrated circuit. The drivers 134, controller 130 and light sources 108 in this example environment of use may benefit from the bias voltage monitoring and control shown and discussed below.

The controller 130 also connects to the pixel matrix 120 to provide one or more control signals to these devices. In this example embodiment, the controller 130 receives image data although in other embodiments it is contemplated that other type data may be sent to the controller. The one or more control signals are sent to the pixel matrix 120 to control the opaqueness of each pixel during different time periods and/or frames and to synchronize its operation with the light sources 108. The term opaqueness is defined to the mean the amount of light which is allowed to pass through a pixel 124 in the pixel matrix 120.

It is contemplated that the pixel may be clear, allowing 100% of the light to pass through (disregarding possible losses in the matrix itself), or opaque, allowing none (or very little) of the light to pass through, or any level of opaqueness there between to allow varying levels of light to pass through each pixel 124 of the pixel matrix 120. In the case of a light reflection or deflection based system, a clear pixel would be a pixel which is perfectly reflecting all the light energy while an opaque pixel would be a pixel that is reflecting light away from the projection lens.

The one or more control signals to the light sources 108 may control the intensity, duration, or other factor regarding the light emitted from the one or more light sources. The driver 134 may also receive control signals which control brightness. There maybe additional feedback or interconnects between elements 108, 134, 130. It should be noted that in this example embodiment, the light sources are not all on at the same time and as such each of the three light sources is on for one third of the duration of a frame. The slow reaction time of the human eye is such that each frame is perceived in full color even though the colors (light sources) are turned on in sequence.

Similar principles as described herein may be applied to a scanning system. The following discusses a laser, or any light source, projection system which scans the image and it is hereby incorporated by reference in its entirety herein: Application Publication Number 20080055557 entitled Method and Apparatus for Controllably Modulating a Laser in a Laser Projection Display. This publication discusses a scanning type projection system.

At the top of FIG. 1 are two example pixel matrixes 120A and 120B, either of which could be utilized. These pixel matrixes are in the light path between the light sources 108 and the screen 116. In the pixel matrix 120 shown at the top of FIG. 1, the part 120 has been rotated 90 degrees to aid in understanding of the pixel screen. In this example embodiment intended for purposes of discussion, the pixels 124 in the pixel matrix which correspond to the first pixel on the viewable image 112 are labeled '1'. The pixels for the second pixel on the viewable image 112 are labeled '2'. As can be appreciated, in this embodiment, the pixel matrix 120A has three pixels 124 for each pixel in the viewable image. In this embodiment, each pixel 124 is assigned to a light source color, such as red, green and blue and is thus controlled during the time period when that light source is emitting light. At other times, it may be opaque, to hinder or prevent light from passing through.

In one embodiment, as shown in pixel matrix 120B, there is a one to one correspondence between the pixels on the pixel matrix 120 and the pixels of the image 112. Each pixel 124 is separately controlled for each period of the frame. For example, if the frame time is divided into 3 time windows, one window for each of Red, Green, Blue light sources then the opaqueness of each pixel 124 would likely be different during each of the three time windows depending on the intensity and color for that pixel for the frame. As such, the opaqueness of each pixel 124 is controlled during the frame to allow the desired amount of light of each color to pass. The eye will tend to blend this light to create the actual desired color. It is contemplated that other methods of selectively allowing light to pass through the pixel matrix 120 may be developed which does not depart from the claims.

Figure 2A:
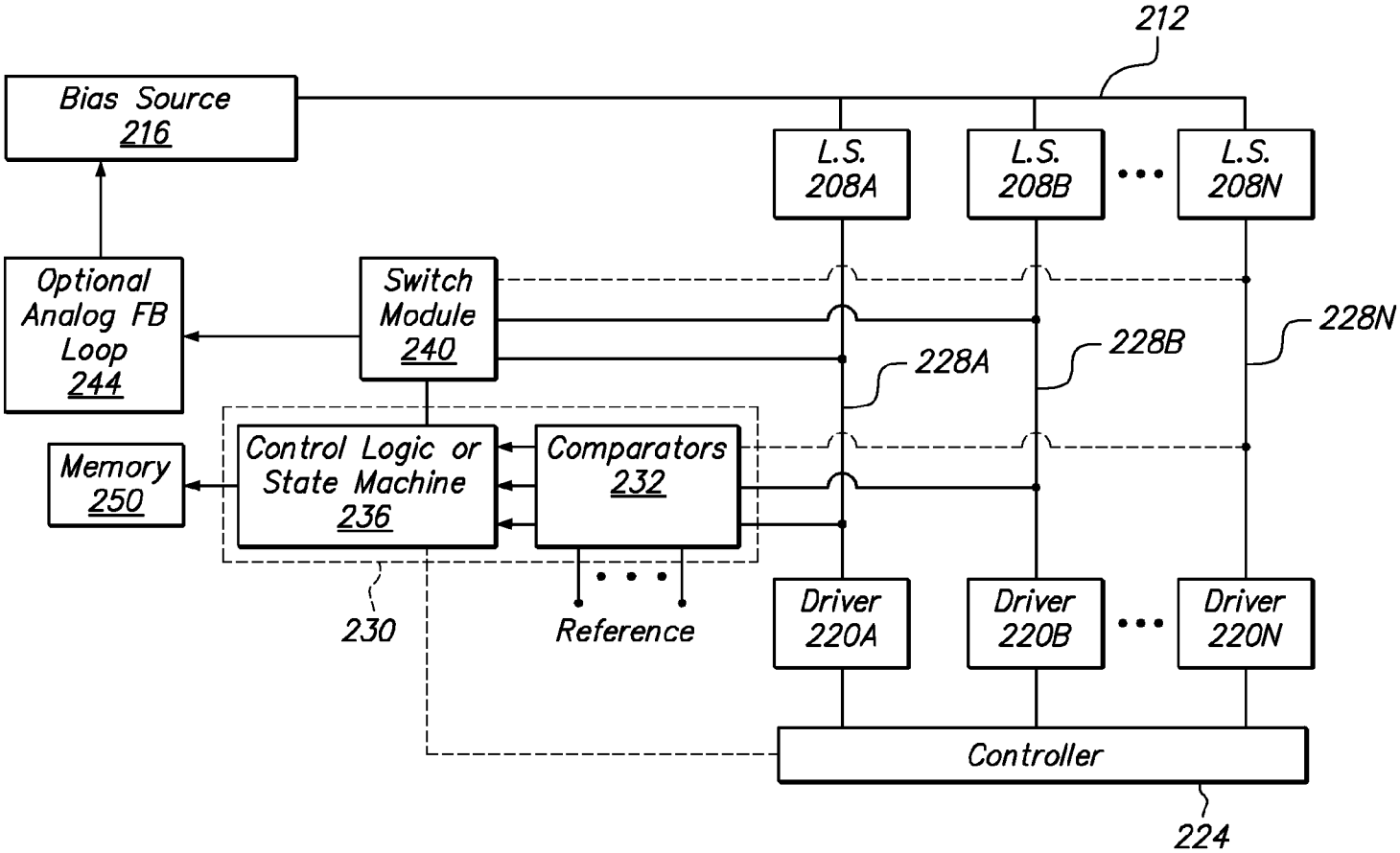
FIG. 2A illustrates a block diagram of an example embodiment of a light source biasing system configured for color mixing and having a reduced number of bias sources.

FIG. 2A illustrates a block diagram of an example embodiment of a light source biasing system configured for color mixing and having a reduced number of bias sources. This is but one possible system and as such it is contemplated that one of ordinary skill in the art may arrive at other embodiments and configurations which do not depart from the scope of the claims that follow.

As shown in FIG. 2A, two or more lights sources 208A-208N connect to a bias node 212. Value of N may be any whole number and as such, any number of light sources may be provided. In addition, during operation the light sources may be established in color mixing mode. The bias node connects to a bias signal source 216. The light sources 208 may comprise any type of light source including but not limited to diodes, lasers, or any other light source. As shown, any number of light sources 208 and corresponding hardware may be implemented into the system. It is common for projection systems to have three or four light sources which range of a different color set such as red, green, blue, white or yellow. For example, some system may have one red and blue LED and two green LED's or a red, green, blue and white LED. The principles disclosed herein may be of benefit to any image or projector system having two or more light sources. The bias source 216 may comprise any type device or system capable of generating and outputting a controllable bias signal. In one configuration the bias source 216 comprises a DC-DC converter.

An opposing terminal of the light sources 208 connects to drivers 220A-220N which are associated with each light source 208. The light source 208 and driver 220 combination may also be referred to as a channel or color channel. One or more of the drivers 220 receive control inputs which determine which channel is the active or primary channel and the current flow through a channel. The current flow through the channel as determined by the driver, responsive to the driver control signal. The control signal controls the light intensity or energy (brightness) emitted from the light source. In this embodiment the driver control signal is generated by a projection system controller. The projection system controller determines the timing and brightness for each image frame.

In this embodiment the light source terminal that connects to the driver 220 is defined as the headroom node 228A-228N. It is contemplated that each light source 208 has an associated voltage drop across the light source. In the case of a diode, this drop across the diode may be referred to as the threshold voltage or the turn-on voltage. The difference between the bias voltage found at the bias node 212 and the drop across the light source 208 is the headroom value, headroom voltage or compliance voltage. The headroom voltage may also be referred to as the compliance voltage. The headroom voltage is the voltage required by the driver to deliver reliably the required current to the light source.

Tapping into at least two headroom nodes is a decision block 230. The decision block 230 is configured to monitor and compare the headroom voltage or value to one or more reference values and perform processing on these values or the results of the comparison to generate control signals. In one embodiment the decision block comprises comparators 232 and control logic 236 as shown. In other embodiments an analog to digital converter can be used to monitor the light source driver headroom and perform a digital comparison to determine which switch connections to establish. Other methods and apparatus may be utilized without departing from the claims that follow.

Returning to FIG. 2A, in this embodiment the decision block 230 comprises comparator(s) 232 and control logic 236. The comparator(s) 232 are configured to compare the headroom value to a reference value. One, some, or all of the headroom values may be provided to the comparators 232. The reference value may be programmed into the comparator 232, based on the bias voltage, or received from a secondary source such as a register or memory. The reference value may be programmed or controlled by a user or system designer. It is also contemplated that the comparator 232 may compare the headroom values on two or more channels. Although shown as a comparator 232, other devices may be utilized to perform this analysis including but not limited to any type analog or digital comparator or a Smith trigger. In one configuration, the comparators output a logic high value or a '1' if the detected headroom value is greater than the reference value and a logic low value or a '0' if the detected headroom value is less than the reference value.

The output of the comparators 232 connect to control logic 236 which is configured to process the one or more outputs from the comparator to generate a switch control signal for a switch module 240. In general, the control logic 236 provides a switch control signal to the switch module 240 to determine which switch input is connected to the switch output. Memory 250 may also be provided and in communication with the control logic 236 (as shown), or the switch module 240. The memory 250 may store the control logic output value or the switch position settings for each sub-frame or frame. Operation of the control logic 236 is described below in greater detail.

The switch module 240 has inputs which connect to light source terminals as shown to receive the headroom value. The switch module 240 has an output which connects to an optional analog feedback loop 224 as shown or directly to the bias source 216. Based on the switch control signal from the control logic 236, the switch module 240 forms a connection between one of the light source terminals to provide a particular headroom value as a feedback signal to the optional analog feedback loop 224 or directly to the bias source 216.

The optional analog feedback loop 244 is configured to properly scale the level of voltage/currents which are fed back to the bias source 216. The feedback loop 24 may also be configured to adjust the loop response time to guarantee proper loop stability and dynamic range. The feedback signal is provided to the bias source 216 which in turn causes the bias source to either increase or decrease the magnitude of the bias signal on the bias node 212.

In operation, the bias source 212 initially outputs or sets a bias voltage or signal and the drivers 220, responsive to driver control signal and image frame data. For each light source to generate a light signal, the bias signal must be at sufficient magnitude, namely greater than the turn on voltage for the light source. In a color mixing environment, more than one light source is on at the same time. Hence, for a red subframe, not only is the red light source on, but also a green light source and/or blue light source. For example, for the red subframe, the red light source may be on 100% of full power but the green and the blue may each only be powered to 15% of full power. This increases brightness and the color shift associated with color mixing is such that it is not perceived by the human eye or it is within the color gamut capability of the light source Each light source may require a different bias signal magnitude to turn on. When color mixing is implemented and multiple light sources are on during every frame then the bias signal must be established sufficiently high for not only the primary channel, but also the secondary channels to insure that the light sources associated with the secondary channels have sufficient bias to turn on and generate light output.

The comparators, control logic, and switch module operate together to detect the headroom values for each channel in relation to the reference values to determine if sufficient headroom is available to obtain proper operation of the light source associated with each channel. The comparators 232 generate an output which is processed by the control logic 236 based on one or more algorithms which in turn results in a switch control signal. Responsive to the switch control signal, the switch module 240 provides the headroom value from a respective channel to the bias source 216 as a feedback signal. This process is described below in greater detail.

Figure 2B:
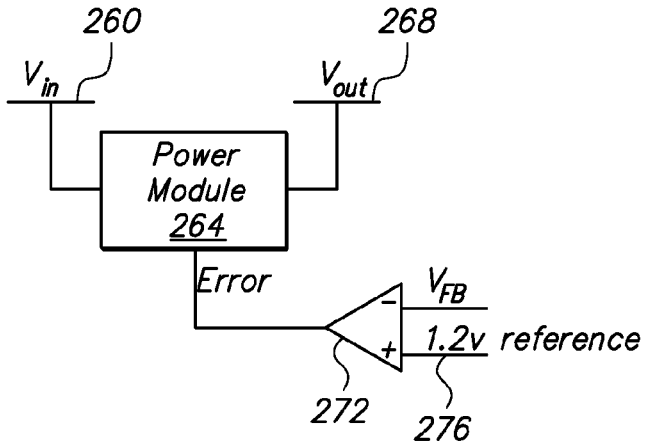
FIG. 2B illustrates a simplified block diagram of the bias source.

FIG. 2B illustrates a simplified block diagram of the bias source. In this example embodiment, a supply voltage $V_{in}$ 260 is provided to the power module 264 which in turn generates an output voltage $V_{out}$ 268 which represents the bias voltage, bias value, or supply signal for the LEDs. Controlling the magnitude of the bias voltage $V_{out}$ 268 is an error signal from a differential amplifier 272 which represents the difference between the feedback signal ($V_{FB}$) and a reference voltage, which in this embodiment is 1.2 volts but in other embodiments the reference value could be any other value, which is compared to the headroom voltage or value. In certain embodiments the feedback signal and reference can also be currents. In this embodiment the reference voltage 276 is a fixed voltage. It may be defined as a voltage divider from Vout to $V_{FB}$ which in turn sets the Vout voltage. In steady state (when the system is stable the value of $V_{FB}$ and the reference are the same. The user may set the value of the voltage Vout by changing the feedback network which is the process performed in various embodiments by controlling the switch or channel selector. This selects the appropriate headroom node 228 or (LED cathode terminal) which therefore changes the feedback network around the bias source 216. As a result, the feedback signal's magnitude in relation to the reference voltage 276 determines the error signal, which in turn increases or decreases the bias signal value.

In operation, when a feedback voltage $V_{FB}$ is provided to the differential amplifier 272, the resulting error signal is the difference between the $V_{FB}$ and the reference voltage 276. If the feedback signal $V_{FB}$ is less than the reference voltage, then the resulting output from the differential amplifier 272 forces the power module 264 to increase the magnitude of the bias signal $V_{out}$. In certain embodiments disclosed herein, this would occur when the headroom value is less the reference voltage thereby indicating that the headroom value should be increased which would occur by increasing the bias voltage $V_{out}$.

In contrast, if the feedback signal $V_{FB}$ is greater than or equal to the reference voltage, then the resulting output from the differential amplifier 272 forces the power module 264 to maintain or decrease the magnitude of the bias signal $V_{out}$. This maintains the bias voltage at its present level, or if the bias voltage is decreased, the power efficiency is increased. It is contemplated that the bias voltage would not be decreased below that necessary to maintain the required headroom value because the feedback signal guarantees that the actual headroom voltage, once the transient response is finished, is exactly equal to the driver's required headroom.

Figure 3:
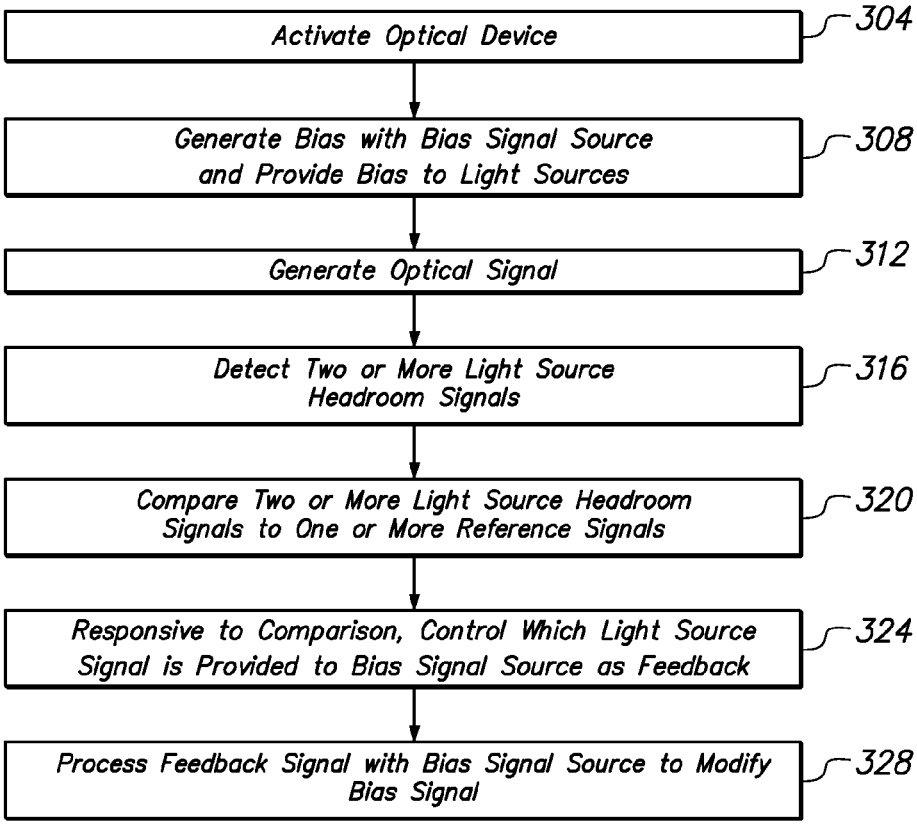
FIG. 3 illustrates an operational flow diagram for one possible method of operation of the system shown in FIGS. 2A and 2B.

FIG. 3 illustrates an operational flow diagram for one possible method of operation of the system shown in FIGS. 2A and 2B. This is but one possible method of operation of the system of FIG. 2A and other methods of operation are possible. To initiate operation of the light source device, the optical device is activated. This occurs at a step 304 and may comprise turning on a projector system or requesting operation or light output from another device. Then, at a step 308 the operation generates a bias signal with the bias signal source and provides this bias to two or more light sources. This causes the two or more light sources to generate an optical signal at a step 312 according to the driver and driver control signal.

As part of this process, at a step 316 the system detects two or more light source headroom signals that are from light sources which are one. With regard to monitoring during a particular subframe, light sources which are not on need not be monitored. The term headroom signal, headroom value, headroom voltage, headroom magnitude, and compliance voltage are used interchangeably herein. It is contemplated that the system may be in color mixing mode causing one or more secondary channel light sources to be concurrently powered and generating an optical signal. The detecting may be done with a comparator other any other processing element. At a step 320, these headroom signals are compared one or more reference signals to determine if the headroom signal is greater than or less than the reference signal. The reference signal establish a baseline or preferred bias voltage. In one embodiment the reference signal is equal to the headroom signal or value. From this comparison, it can be determined whether the bias signal is of sufficient magnitude for each channel.

At a step 324, the operation, responsive to the comparison of step 320, controls which light source signal is provided to or is used to generate the feedback signal to the bias signal generator effectively changing the feedback factor of the DC-DC converter (bias source). At a step 328 the bias source processes the feedback signal to dynamically modify the bias signal to a value tailored to actual performance and headroom requirements. In one embodiment, the bias signal generator processes the feedback signal to determine the change, if any, to the bias signal. In another embodiment an analog feedback loop or a counter with associated DAC (digital to analog converter) performs this function in connection with the bias source.

Operation continues in this manner to dynamically adjust the bias signal to suit the biasing requirements, which may change over time, while also maintaining optimal power efficiency, of the optical system. It is contemplated that one or more bias levels or switch position signals may be stored in memory and recalled, on a frame by frame basis or based on brightness level settings.

In addition to the system of FIG. 2 set forth above, also disclosed is to utilize a more than one DC-DC converter (bias source) less than the number of light sources in a projector system. Hence, one or multiple DC-DC converts may be utilized but there are a greater number of light sources such that at least one DC-DC converter is shared between light sources. This provides the benefits of power efficiency with reduced number of bias sources.

As can be appreciated, the methods and techniques highlighted in these innovations achieve automatic identification and selection of the light source (LED/laser) that has the highest voltage drop so that system designers, engineers, and manufactures (hereinafter integrators) have the capability of trading off efficiency for cost of material and board area to obtain the best overall system from an electrical stand point. From an optical standpoint the system integrators can adjust current into each of the light sources to achieve the optimal trade-off between brightness and color saturation without having to worry about the details of the implementation.

In actual systems, the capability to automatically identify and set biasing, such as in this embodiment the common anode voltage, for the light source that has the highest voltage drop is extremely important because blue and green light sources usually have similar drops so the loss in efficiency from using a single converter multiplexed between these light sources is negligible. Moreover, many systems employ multiple light sources (LED or laser diodes) of the same color configured in parallel to obtain higher brightness. Theoretically, the drop across the same light sources type and model is constant for the same current however tolerances in the devices will cause small variations in the drops which forces system integrators using prior art techniques to use a separate DC-DC converter whenever more then one source is turned on at the same time.

In addition to the method and apparatus described above additional methods and apparatus is disclosed which provide greater capability but at a slight increase in complexity, although such increased complexity is negligible upon implementation and design. For example, the method described in connection with FIG. 2 and FIG. 9 works well when two or three channels need to be monitored. If more then two channels needed monitoring the scheme would increase significantly in complexity since the number of comparators needed is equal to 2^(n−1) the number of light sources or in the case of an ADC implementation a number of ADC equal to the number of channels. The method and apparatus discussed in connection with the following figures addresses the need to monitor and select multiple channels.

Figure 4:
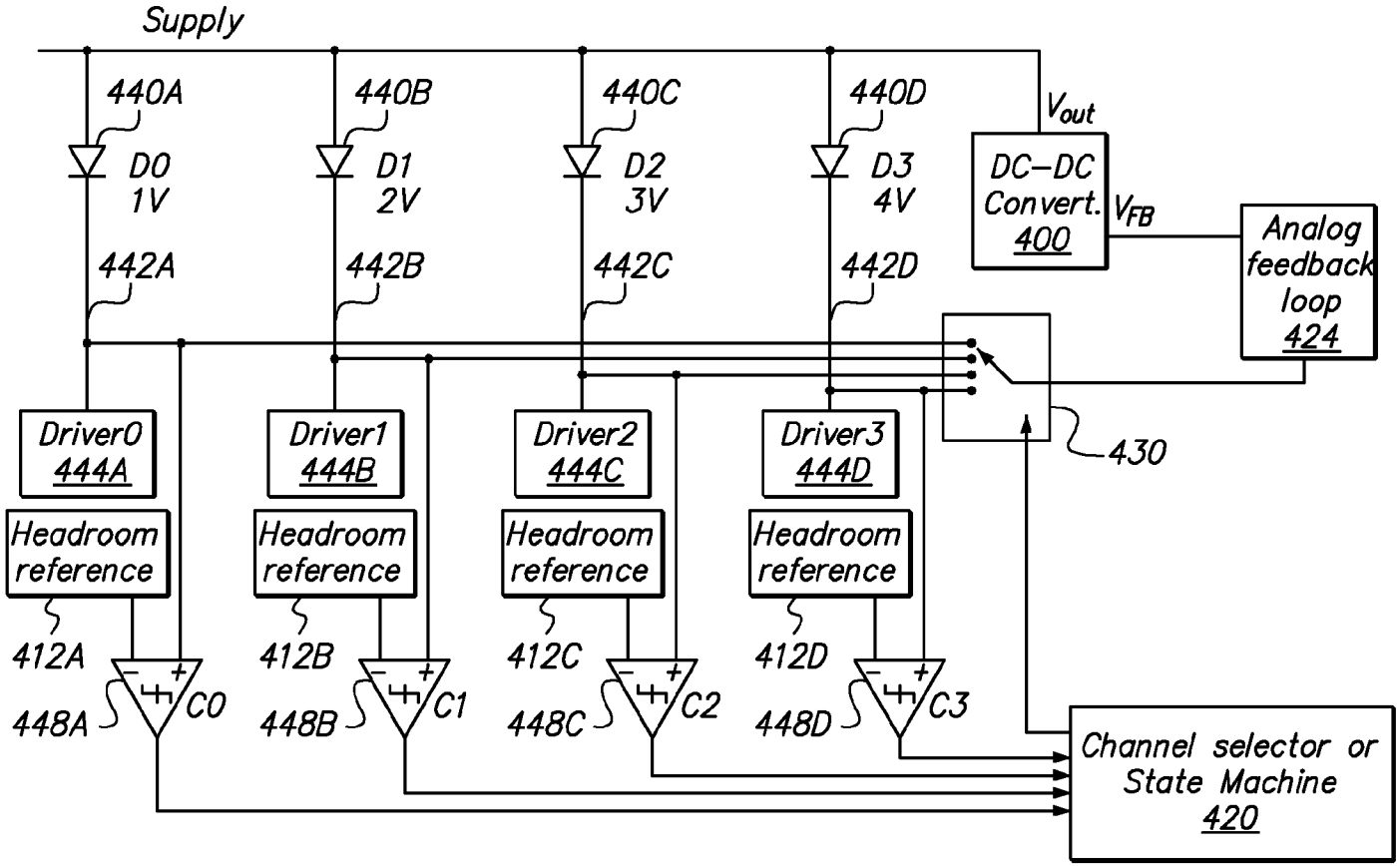
FIG. 4 is a block diagram of an exemplary embodiment of a multi-channel color mixing or de-saturation system with a single DC-DC converter.

FIG. 4 is a block diagram of an exemplary embodiment of a multi-channel color mixing or de-saturation system with a shared DC-DC converter, such that the number of DC-DC converters is less than the number of light sources. The system could be embodied with greater than one DC-DC converter. In this example embodiment, a bias or supply source node is shown at the top of the drawing as a supply voltage and current source with supply from the DC-DC converter 400. The DC-DC converter 400 is one possible implementation of the bias source 216 shown in FIG. 2A. It is contemplated that any power source may be utilized in addition to or instead of a DC-DC converter 400 to serve as a source of the bias signal. In other embodiments, the DC-DC converter could be replaced by a switching regulator, current source, voltage source, low dropout regulators, switching converter, or any type DC-DC converter whether configured with indictors, capacitors, or both.

Light sources, D0-D3 440A-440D connect to the output of the DC-DC converter 400. The voltage across the light sources D0-D3 440 and the current there through is controlled by the drivers 444A-444D associated with each channel labeled Driver0-Driver3. The drivers 444 receive a control signal (not shown in FIG. 4) to control the current through the light source 440, which in turn controls the brightness of the light source optical output. For each channel, the node between the light source 440 and the driver 444 is defined herein as the headroom node 442A-442D and on this node is the headroom signal or value.

Connecting to the electrical connection between the drivers and the light source D0-D3 are comparators C0-C3 448A-448D which monitor each light source and compare this signal to a reference signal or reference value from a reference block 412A-412D as shown. In one embodiment, the signal comprises a headroom signal and the headroom signal is compared to a desired headroom value from the headroom reference block 412. The reference block may comprise memory, registers, or a voltage divider network. The term headroom is defined herein as the supply voltage minus the turn-on or threshold voltage for the diode. For example, if the bias or supply voltage is 4 volts, and a particular diodes turn on or threshold voltage is 3 volts, then the headroom for that channel is 1 volt, which is the difference between the voltage drop across the diode and the supply voltage.

The comparators C0-C3 448 compare the light source headroom signal to the reference signal. Based on this comparison, each comparator C0-C3 448 outputs a logic zero (0) or logic one (1). The information (digital output) from the comparators 448 is processed by a channel selector 420 according to a channel select algorithm. The channel selector 420 may comprise control logic, a state machine, a microprocessor, ASIC, or any other element capable of performing as described herein. In this embodiment a 0 output from a particular comparator 412 indicates that the headroom value is less than the reference value for that channel and is an indication that the supply voltage is less than that required or preferred for proper operation of the light source for that channel. The reference signal or reference value depends on or may depend on many parameters including but not limited to architecture of the driver or bias source, current to be delivered to the light source, operating condition of the driver (such as supply and/or temperature) and the type of light source. The reference value could be a fixed reference voltage.

The output of the channel selector 420, which connects to a switch module 430, comprises a switch control signal. Responsive to the switch control signal, the switch module 430 connects its output to one of the inputs which connect to the headroom nodes 442. If the light sources comprise diodes, then the headroom node is a cathode terminal of the diode.

The rule of operation or the channel selection algorithm for this embodiment is that for a particular subframe, the channel selector 420 detects which comparator output is '0' and controls the switch module to connect the output of the switch module to a channel with a '0' comparator output. During this time, the feedback signal forces the output of the DC-DC converter 400 to increase the supply voltage, which also causes the headroom value to increases in value. The channel selector state machine 420 controls the switch to maintain the connection between the switch module output and the headroom node for the channel that has the comparator output of '0'. Eventually, due to the increasing supply voltage (and resulting increasing headroom value) the comparator output for that channel will switch to a logic '1' value. This indicates that the headroom value for that channel is no longer less than the reference value for that channel and hence is of sufficient magnitude for operation.

Once the comparator output for the channel transitions to a '1' value, the channel selector 420 detects if any other comparator outputs are at a '0' value and if so, the channel selector 420 actuates the switch 430 to connect the switch output to headroom node for a channel having a comparator output at a '0' value. As a convention the selector can chose among the channels whose comparator has "0" output the one with the lowest index but it is self evident that the selection of any channel would work as long as the output is a '0' value. The processes described above occurs until all comparators output a '1' value. In that case the selector does not move from the current channel selected and the DC-DC converter voltage will start to decrease based on the fact the headroom on all channel is higher then desired. The selector state does not change anymore and the appropriate feedback is selected around the DC-DC converter so that the supply output is continuously adjusted by the DC-DC converter to the proper value equal to the maximum $V_{LED}$ drop across the light source in the current subframe condition plus the headroom voltage.

This operational rule allows the selection of the channel in the loop with the highest voltage drop across the light source (highest turn-on or threshold voltage) which also indicates the lowest headroom and will force the DC-DC converter 400 to increase the supply voltage to the level that will properly bias the light source D0-D3 for that channel. At this time, all the light sources are sufficiently biased. In this embodiment the DC-DC converter increases its output because inside the DC-DC converter is an error amplifier configured to compare the external $V_{FB}$ input with an internal accurate reference voltage. If the $V_{FB}$ is lower then the reference voltage the internal circuitry of the DC-DC converter forces its output to increase.

The output of the switch module connects to an analog feedback loop 424. In other embodiments, the output of the switch module 430 may connect to any other device that is configured to function as the analog feedback loop. It is also contemplated that the output of the switch module 430 may connect directly to the DC-DC converter 400. Voltage scaling may occur to match voltage levels. The output of the analog feedback loop 424 connects to the DC-DC converter 400. The DC-DC converter 100 processes the signal from the analog feedback loop 424 to generate the supply voltage which is at a magnitude sufficient to turn on all the light sources D0-D3 440 which are called to emit light by the drivers responsive to control signals.

The feedback loop 424 could also be embodied in a digital format. The analog feedback loop 424 sets or scales the feedback signal $V_{FB}$ provided to the DC-DC converter. The feedback loop 424 may also be configured to introduce poles and zeros to help stabilize the loop. The DC-DC converter 400 then processes the feedback signal to establish its output at a magnitude that properly bias the light sources. Stated another way, the analog feedback loop acts on the feedback signal to the DC-DC converter 400 to increase/decrease the DC-DC converter output voltage and with that the anode voltage for diode light sources to a level which not only meets the turn on or threshold voltage for each light source which is on at a particular time, but also establishes an amount of headroom or safety margin at the cathode of the diode light source to match the reference value.

By connecting the switch 430 to a channel as described above which has an cathode node voltage which is less than the reference value for that channel, the output of the switch and the switch itself establishes a loop which includes a light source (one of the light source D0-D3 440), the feedback loop 424, and the DC-DC converter 400. This loop provides the feedback signal to the DC-DC converter 400 which in turn allows the supply voltage to settle at the proper value as determined by the feedback signal.

Figure 5:
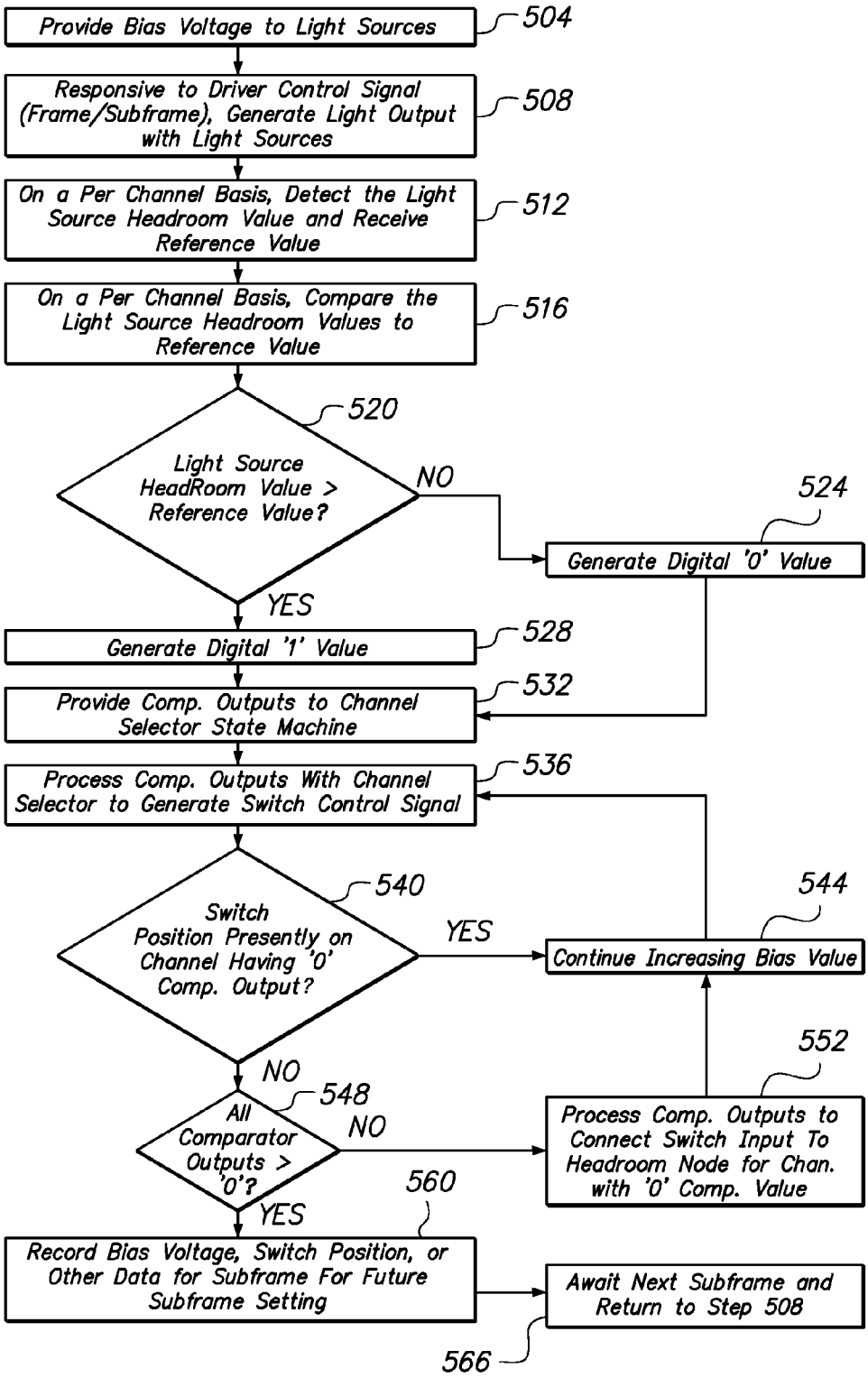
FIG. 5 illustrates an operational flow diagram of an exemplary method of operation associated with the embodiment of FIG. 4.

FIG. 5 illustrates an operational flow diagram of a exemplary method of operation associated with the embodiment of FIG. 4. This is one possible method of operation and one of ordinary skill in the art may develop other methods of operation without departing from the claims that follow. This method of operation establishes the headroom for every channel at the reference value.

At a step 504 the DC-DC converter provides a bias voltage to the light sources. It is preferred that this bias voltage be sufficient in magnitude to achieve light emission from the light source, particularly in a color mixing environment such that during a sub frame, more than one light source is on. At a step 508, responsive to a driver control signal provided to a driver and for each frame of subframe of a projected image, the driver establishes a current through the light source according to the a brightness as set by the driver control signal. The brightness may be established by a projection control system which sets the brightness level based on a predetermined brightness or based on a brightness level for a particular frame or subframe. As a result, if the bias voltage and the headroom voltage is of sufficient magnitude, light output is established from the light sources.

At a step 512, each comparator detects or receives a headroom value from the headroom node associated with each channel. Also at step 512, the comparator for each channel receives a reference value associated with each channel. The reference value may be stored in a memory, register, or established with a voltage divider network, passive element network, or active element network.

Next, at a step 516, the comparator compares each light source headroom value to the corresponding reference value for that channel. At decision step 520, each comparator determines if the light source headroom value is greater than the reference value. If the comparison at decision step 520 determines that the headroom value is less than the reference value, then the operation advances to a step 524 and the comparator outputs a low logic value, such as a '0' value to the channel selector at a step 532. Alternatively, if the comparison at decision step 520 determines that the headroom value is not less than the reference value, then the operation advances to a step 528 and the comparator outputs a high logic value, such as a '1' value, to the channel selector at step 532.

Next, at a step 536, the channel selector processes the digital inputs with logic or other processing elements to generate switch control signals according to the switch control algorithm.

In general and as set forth above, the switch control algorithm, as executed by the channel selector, selects which of the channels/light sources, such as LEDs, needs the highest voltage. In particular, this occurs by advancing to decision step 540 such that the channel selector determines if the switch position is connecting a switch input to a headroom node for a channel which has a comparator output which is a low logic or '0' level If so, then the operation advances to step 544 and the bias system continues increasing the bias or supply voltage and then returns to step 536. Although shown in step by step flow chart, it is contemplated that this process continually occurs. During the time period associated with steps 528-544, if the feedback signal is less than the reference value then the bias voltage is continually increasing or ramping up as part of the analog loop operation. The bias voltage is increased because the headroom value, which is less than the reference value, is presented as a feedback signal to the DC-DC converter. A feedback signal which is less than the reference value causes the DC-DC converter to increase the bias or supply voltage.

Alternatively, if at decision step 540, the channel selector determines that the switch input is connected to a headroom node for a channel comparator output that is not a low logic value or '0' then the operation advances to decision step 548. At decision step 548 the channel selector determines if all the comparator outputs are greater than a low logic level or above '0'. If all the comparator outputs are at high logic level or a '1', then all the headroom values are greater than the corresponding reference values on a channel by channel basis.

Consequently, the channel selector output does not change and the switch position remains the same. In one embodiment the DC-DC converter decreases the bias voltage maintain a high power efficiency.

If at decision step 548 all the comparator outputs are not greater than a low logic level or '0', then the operation advances to step 552. At step 552 the channel selector state machines processes the comparator outputs to connect the switch input to a headroom node for a channel with a logic low level or '0' output. The headroom value on that headroom node is then provided as the feedback signal to the DC-DC converter or the analog feedback loop and at step 544 the bias or supply voltage is increased.

Alternatively, if at decision step 548 all of the comparator outputs are at a high logic level or '1', then the operation advances to a step 560. As set forth above, the channel selector output does not change and the switch position remains the same resulting in the DC-DC converter decreasing the bias voltage. At step 560, which occurs at the end of a sub-frame or in response to some other event, one or more of the bias voltage, switch position, or other data representing the bias voltage or some other aspect of the system establishing the bias voltage is stored in a memory or register for recall and use during future subframes or frames. While it is contemplated that bias voltage calculation process is dynamic and ongoing, by optionally storing for future use the bias voltage system settings in a memory or register, approximate or prior settings may be quickly recalled and established. This allows the system to maximize light sources on time and optimized efficiency. It is contemplated that the storing in memory of one or more settings which are retrieved for future use may be enabled with any embodiment or method of operation disclosed herein.

During operation, the comparators and channel selector continue to monitor for any comparator output with a zero output and will generate a switch control signal in response to connect the switch input to the headroom node for the channel having a '0' comparator output. After step 560, the operation advances to step 566 such that the bias voltage setting is maintained for the remainder of the subframe, or frame, and then the operation return to step 508 or other earlier step to continue system processing for additional image frames or subframes.

Figure 6A:
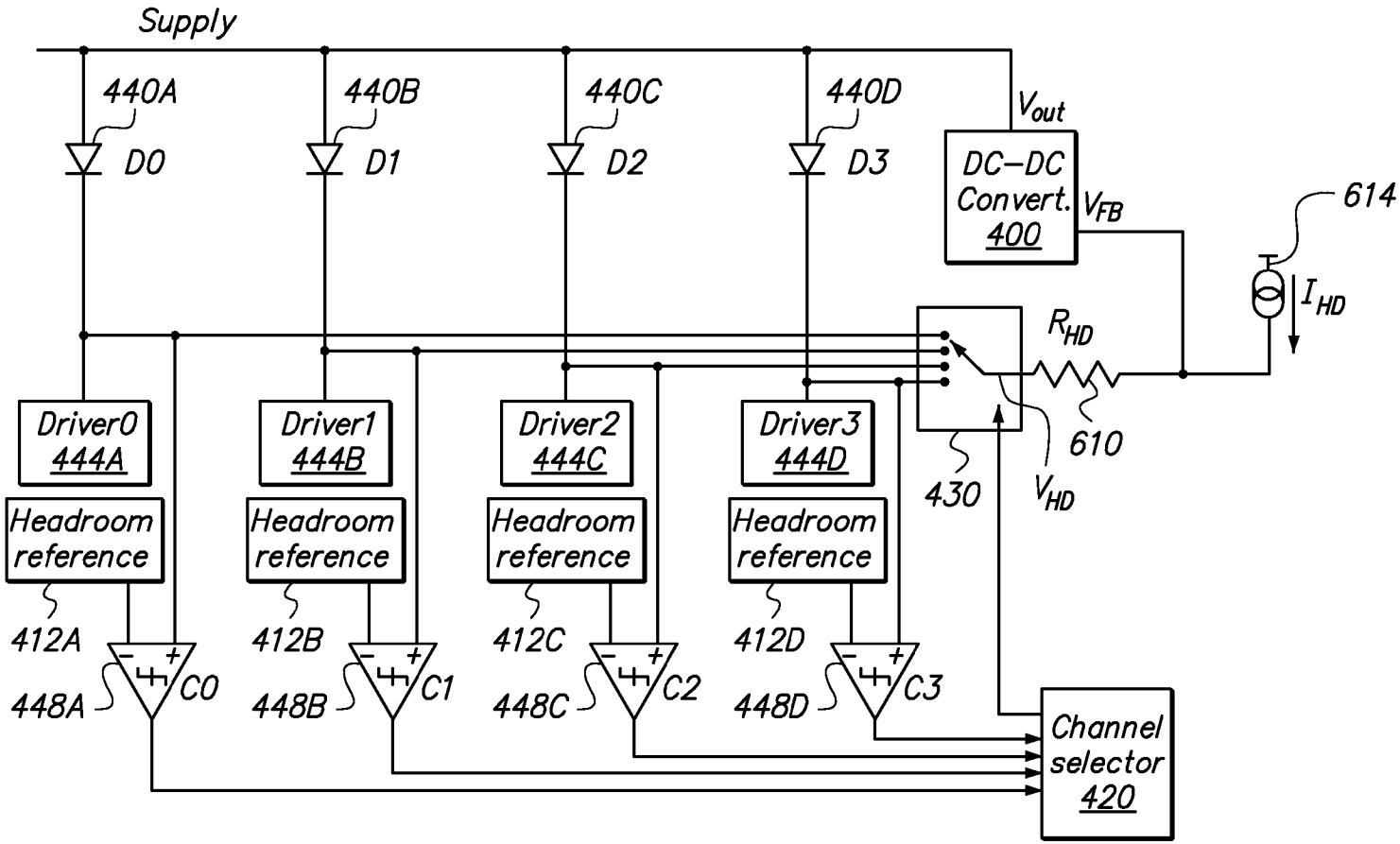
FIG. 6A is a block diagram of an exemplary embodiment of an analog feedback loop in a color mixing or de-saturation system with a single DC-DC converter.

An example implementation of a bias level control system having an analog feedback loop is shown in FIG. 6A. FIG. 6A is a block diagram of an exemplary embodiment of an analog feedback loop in a color mixing or de-saturation system with a single DC-DC converter. In this embodiment, identical or similar elements in relation to FIG. 4 are labeled with identical reference numbers. Only the aspects of FIG. 6A which differ from FIG. 4 are discussed in detail. In this embodiment, the switch 430 will select the light source D0-D3 440 with the highest drop. A resistor $R_{HD}$ 610 and a current source 614 are provided as shown. The resistor $R_{HD}$ 610 connects to the switch output terminal and to a node which connects to the current source 614 and the DC-DC converter 400. The current source 614 outputs a signal $I_{HD}$ to establish a voltage $V_{HD}$. In this configuration, the headroom value at the headroom node 442 associated with the light source D0-D3 440 with the highest drop is determined by the $V_{FB}$ (voltage feedback) of the DC-DC converter 400 minus the voltage given by the $I_{HD}$ times $R_{HD}$. Hence, the current $I_{HD}$ through the resistor 610, shown as $R_{HD}$ is subtracted from the voltage $V_{FB}$ which in turn sets the headroom for the driver. Therefore, as the switch 430 selects a different channel 0-3, the voltage output by the switch will change. As a result, the voltage across the resistor $R_{HD}$ 610 will change. When the loop is in a stable state the $V_{FB}$ can be considered a virtual ground. The resistor and the currents are used to reduce the headroom. The $V_{FB}$ could be connected directly to the output but usually the $V_{FB}$ is a fairly high voltage (typically a bandgap voltage ~1.2V) and that would impact the efficiency of the system, so the headroom voltage or value is scaled down.

Figure 6B:
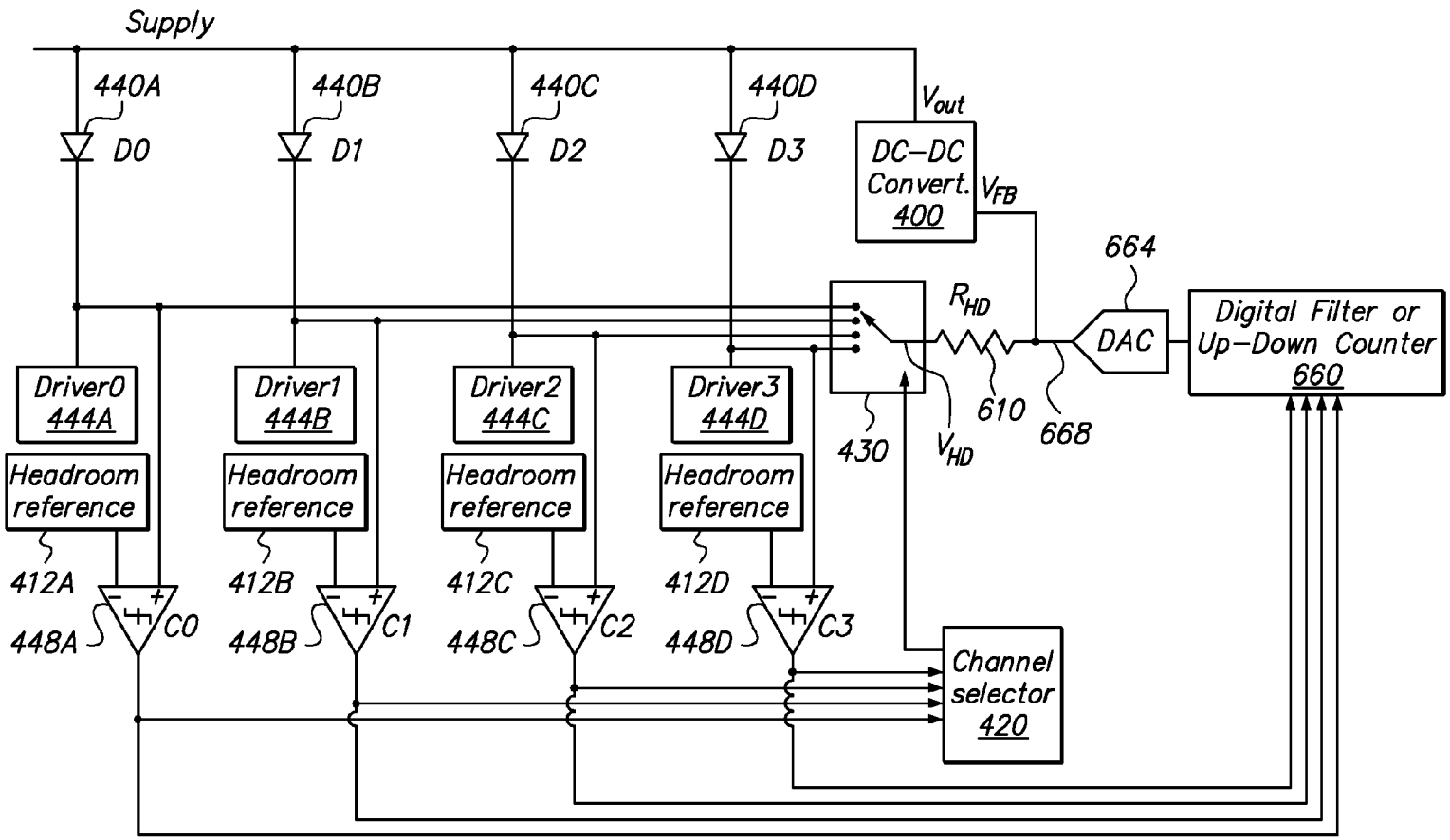
FIG. 6B illustrates a block diagram of an example embodiment having a digital filter and digital to analog converter replacing the current source of FIG. 6A.

FIG. 6B illustrates a block diagram of an example embodiment having a digital filter and digital to analog converter replacing the current source of FIG. 6A. This example implementation of the feedback loop utilizes a digital filter and digital to analog converter as is shown in FIG. 6B. In other embodiments, other elements may be utilized to enable a digital solution. FIG. 6B is contemplated for use in a embodiment that utilizes color mixing or de-saturation with a single DC-DC converter or fewer number of DC-DC converters that light sources. In this embodiment, identical or similar elements are labeled with identical reference numbers as compared to FIG. 6A. Only the aspects of FIG. 6B which differ from FIG. 6A are discussed below.

In this embodiment the outputs from the comparators 448 also connect to a digital filter 660 which receives and processes the various inputs to generate a digital code as an output. The digital code represents a value corresponding to the number of comparator outputs which have a high or low logic level output. In one embodiment the digital code is a running total of the comparator outputs over time. In another embodiment, the digital code is a representation of the comparator outputs at any one time, such as a snapshot of the comparator outputs. The digital filter may be programmable to enable greater functionality as discussed herein. The digital filter may also comprise a counter, control logic, state machine, or any other element configured to operate as described herein.

The digital code is provided as an input to a digital to analog converter 664 which converters the digital code to an analog signal that is output on feedback node 668. The elements 660, 664 replace the current source 614 shown in FIG. 6A.

The digital filter 660 generates a digital code or digital feedback signal responsive to the comparator output. The digital to analog converter converts the digital feedback signal to an analog format and presents the analog feedback signal to feedback node 668. The opposing terminal of the headroom resistor 610 connects to a headroom nodes for each channel. The headroom resistor 610 acts as a voltage divider or scaling device to set or scale the feedback signal presented to the DC-DC converter 400 to a level that minimized power consumption while also setting the feedback signal in relation to a reference voltage within the converter 400.

Figure 6C:
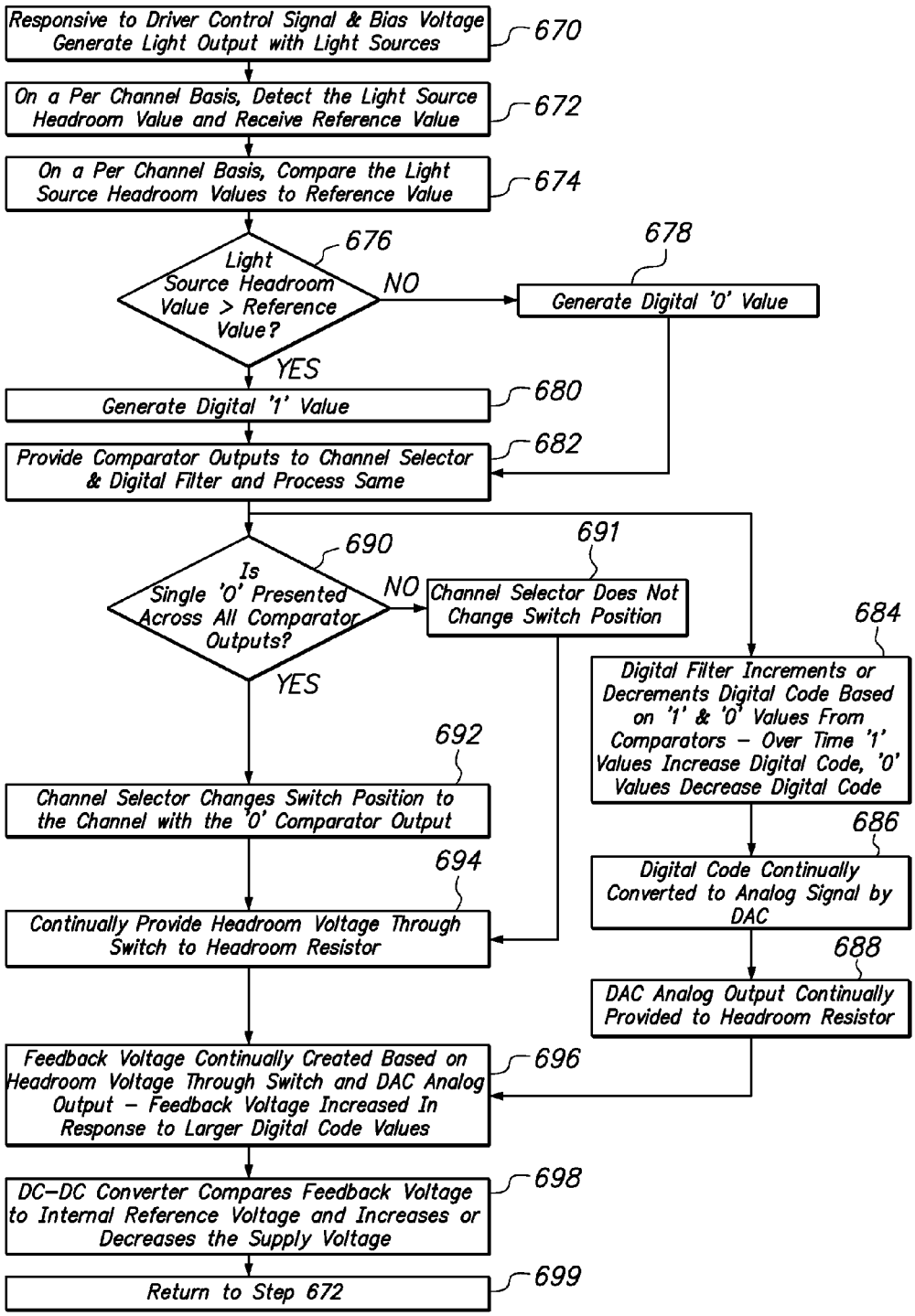
FIG. 6C illustrates an operational flow diagram of an exemplary method of operation associated with the embodiment of FIG. 6B.

FIG. 6C illustrates an example method of operation of the system shown in FIG. 6B. This is but one possible method of operation and as such, other methods of operation based on the principles of FIG. 6B may be arrived at without departing from the claims that follow.

At a step 670, responsive to a driver control signal provided to a driver and for each frame of subframe of a projected image, the driver establishes a current through the light source according to the a brightness as set by the driver control signal and subject to the bias voltage. The brightness may be established by a projection control system which sets the brightness level based on a predetermined brightness or based on a brightness level for a particular frame or subframe. As a result, if the bias voltage and the headroom voltage is of sufficient magnitude, light output is established from the light sources.

At a step 672, on a per channel basis, each comparator detects or receives a headroom value from the headroom node associated with each channel. Also at step 672, the comparator for each channel receives a reference value associated with each channel. The reference value may be stored in a memory, register, or established with a voltage divider network, passive element network, or active element network.

Next, at a step 674, the comparator compares each light source headroom value to the corresponding reference value for that channel. At decision step 676, each comparator determines if the light source headroom value is greater than the reference value. If the comparison at decision step 676 determines that the headroom value is less than the reference value, then the operation advances to a step 678 and the comparator outputs a low logic value, such as a '0' value to the channel selector at a step 682. Alternatively, if the comparison at decision step 676 determines that the headroom value is not less than the reference value, then the operation advances to a step 680 and the comparator outputs a high logic value, such as a '1' value, to the channel selector at step 682.

At a step 682, the outputs of the comparators are provided to the channel selector and to a digital filter. The channel selector and the digital filter process the comparator outputs as discussed below. At this stage, the flow chart branches to concurrently executing branches at steps 690 and step 684. At step 684, the digital filter increments or decrements a digital code based on the '1' and '0' values from the comparators. Over time, the digital code increases in response to '1' values and decreases in response to digital '0' values. At a step 686 the digital code is continually converted to an analog signal by the digital to analog converter (DAC) and at a step 688 the analog output of the DAC is continually provided to the headroom resistor. After step 688, the operation advances to step 696, which is discussed below.

The other concurrently executing path of the flow chart involves operation of the channel selector. From step 682 the operation also advances to decision step 690 where it is determined if a single '0' output is presented across all of the comparator outputs. Stated another way, are all of the comparator outputs a '1' value except for one? If not, then the operation advances to step 691 and the channel selector does not change the switch position. As a result the switch maintains its existing connection to one of the headroom nodes between a light source and driver.

Alternatively, if at step 690 the decision step determines that only one comparator output is a '0' value, the channel selector changes the switch position at step 692 to connect the switch input to the channel with the comparator output which is '0'. Then at step 694 the switch continually provides the headroom voltage through the switch to the headroom resistor as shown in FIG. 6B.

Then, at a step 696 a feedback voltage is continually created based on the headroom voltage through the switch and the DAC analog output. In this embodiment the feedback voltage is increased in response to a larger digital code value. At a step 698 the DC-DC converter compares the feedback voltage to an internal reference voltage and in response to this comparison increases or decreases the magnitude of the supply voltage. It is contemplated that this operation continues to dynamically adjust and maintain the supply voltage so at a step 699 the operation returns to step 672.

In generally, the channel selector of FIG. 6B operates such that if multiple 0 or multiple 1 signals are presented to the channel selector 420 then the output of the channel selector 420 does not change and hence the configuration of the switch 430 does not change. During this period it is contemplated that the supply voltage is increasing because some of the comparator outputs are '0' values. '0' comparator outputs indicate that a channel's headroom value is too low. The digital filter processes this information increasing the code of the DAC whenever at least one comparator output is 0. This causes the output of the DAC to increase so more current is pushed into the headroom resistor causing the supply to increase even though the selector is connected to a driver whose headroom is higher then the desired value (i.e. the comparator output is '1').

When only one comparator output is '0', the channel selector connects the switch input to that channel since it is now determined that there is only one channel left with the headroom below the desired value.

This method of operation has several benefits. One such benefit is that this method limits the number of switch position changes which in turn reduces noise and signal transients. This results in smoother operation and faster settling time of the supply voltage. In addition, varying the current output by the DAC avoids use of a constant current. A constant current may result in a large voltage drop across the $R_{HD}$ which can create a large mismatch and a big variation in headroom voltage. This method may be considered to perform auto calibration where the current is adjusted to a value that achieves accurate headroom. In typical DC-DC converters the $V_{FB}$ voltage is in the order of 1.2 volts (V). If a 100 mV headroom is desired, the drop across the resistor must be in the order of 1.1V. If, because of normal mismatches/errors in circuits, the error on this generated voltage is only +/−3% (i.e. +/−33 mV) for example, the headroom would change between 67 mV and 133 mV therefore by +/−33%. However, with the proposed solution the headroom reference signal or value and the comparator may also have an error. The error will be due to the same factors and will likely be on same order of magnitude of 3%. If the headroom value is 100 millivolts with 3% error then there is only +/−3 millivolts of error instead of +/−33 millivolts of error as would be experienced with the non-calibrated embodiment.

Figure 7:
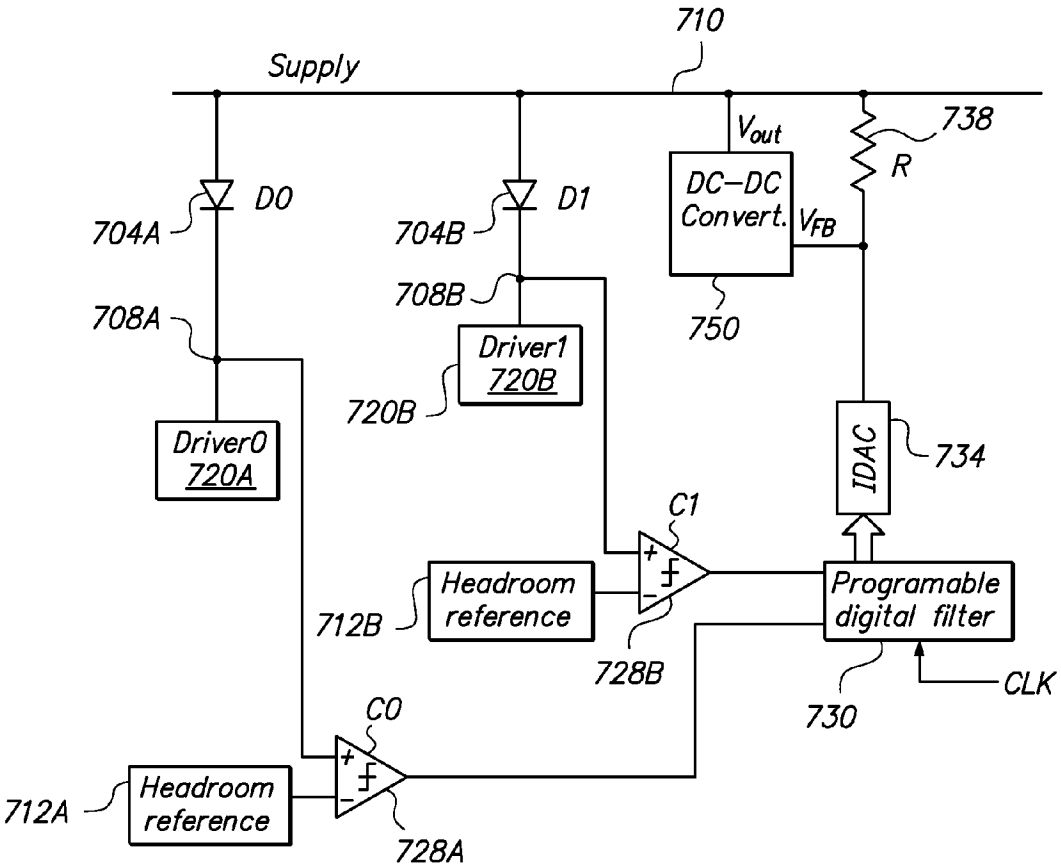
FIG. 7 is a block diagram of an exemplary embodiment of a color mixing or de-saturation system having a single DC-DC converter and a digital to analog converter sourcing current based on a digital code.

FIG. 7 is a block diagram of an exemplary embodiment of a color mixing or de-saturation system having a single DC-DC converter and a digital to analog converter sinking current based on a digital code, such as from a counter or digital filter. This is but one possible embodiment and as such it is contemplated that one of ordinary skill in the art may arrive at alternative but related embodiments. Although shown for purposes of discussion with two channels, the number of channels can be expanded to any number of channels with a corresponding increase in elements associated with each channel and number of inputs to the digital filter. With reference to FIG. 7, a supply 710 is provided to provide a bias voltage to light sources D0-D1 704A, 704B. The light sources may comprise any light source including but not limited to diodes or lasers. The opposing terminal of the light sources D0-D1 connects to a headroom node 708A, 708B which in turn connects to drivers 720A, 720B and as an input to comparators C0-C1 728A, 728B. The drivers 720 provide the drive current to the light sources to achieve light output to generate the image, whether still or motion based. A control signal (not shown) is presented to the drivers 720 to control drive current and hence brightness of the light output from the light sources 704.

The comparators C0-C1 728 compare the headroom value to a reference value, which is received from the headroom reference modules 712A, 712B. The reference modules 712 may comprise any device capable of generating or storing a reference voltage or signal, such as but not limited to memory or registers. The outputs of the comparators C0-C1 728 connect to a digital filter 730, which in this example embodiment is programmable. The digital filter 730 also receives a clock signal as shown. The digital filter 730 processes the inputs from the comparators 728 to generate a digital code. The output of the digital filter 730 comprises a signal, which is provided to a current sourcing digital to analog converter (DAC) 734. As is understood, a current DAC converts a received digital signal to an analog format. The output of the DAC 734 connects to a resistor R 738 and a DC-DC converter 750. The opposing terminals of the resistor R 738 and the DC-DC converter 750 connect to the supply node 710.

In operation, the light sources D0-D1 704, drivers 720, comparators C0-C1 728 and the headroom reference modules 712 are configured as described above. The digital filter 730 receives as inputs the logic one '1' and logic zero '0' outputs from the comparators C0-C1 728. These values represent whether the DC-DC converter output, minus the voltage drop across the light sources, is above or below the headroom reference value. The digital filter output is a signal representative of the comparator output. For example, if the output of the digital filter 730 is below predetermined value, then the comparator output indicates that the bias or supply voltage should be increased. If the output of the digital filter 730 is above the predetermined value then the comparator output indicates that the bias or supply voltage is sufficient or should be decreased. Thus, in this configuration, the current DAC 734 pushes an amount of current into the resistor R 738 that is related to or controlled by the signals from the comparators C0-C1 728. When the DC-DC converter loop is closed and settled (i.e. the part operates in stable conditions) the $V_{FB}$ voltage is constant therefore the output of the DC-DC converter is given by the equation $V_{FB}+I_{DAC}\cdot R$.

The code for the DAC 734 is generated by the digital filter 730 which, in its simplest embodiment, is a counter that counts up or down depending on the input from the headroom monitoring comparators C0-C1 728 according to, for this example embodiment, the following rule: if any of the comparator output is low (0) increase the output code otherwise decrease the output code from the digital filter 730. An increase in the output code from the digital filter 730 corresponds to or forces an increase in IDAC current from the DAC 734 and therefore an increase in DC-DC converter output, i.e. the supply or bias voltage on node 710 increases.

When both drivers 720 are turned on at the same time, they provide the desired current to or through their respective light sources D0-D1 704 as long as the headroom value or compliance voltage of the drivers is sufficient for the desired current. When two or more light sources 704 are on, the system may be in color mixing mode. Each light source D0-D1 704 will have its own voltage drop depending on its characteristics and the current that flows through it. The comparators C0-C1 728 compare the headroom reference value from module 712 with the actual headroom value on node 708 and, if one of the actual headroom values is below the desired value, the output of the respective comparator C0-C1 will be low and therefore the current from the IDAC 734 will be increased and with it the output of the DC-DC converter 750 which in turn will raise the headroom.

In this manner, the system will reach stability around the point where the channel (such as channel A or channel B) having the light source D0-D1 704 with the highest voltage drop will operate at its optimal headroom as specified by the headroom reference value stored in the headroom reference module 712.

Compared to the previous methods and apparatus shown above, in this scheme the light sources 704 do not come into the DC-DC converter loop (in this embodiment the DC-DC converter loop is closed through the resistor R 738 as opposed to the light sources D0-D1, the selector switch and $R_{HD}$ in the prior embodiment). This makes the system easier to control and make stable. However, unless a very fast digital engine (730, 734) is used this method and apparatus may yield higher output voltage settling times and therefore slower current settling times, such as when the current in the light sources is changed or the DC-DC converter is switched to other sources. This is because to maintain loop stability there must be only one dominant pole. The dominant pole can either be the Dc-DC converter dominant pole (in that case the speed of settling will be comparable to previous method) but that may requires a digital filter operating in the order of hundreds of MHz for proper stability. In the event the dominant pole is created by the digital filter, then that must be several frequency decades lower then pole of the DC-DC converter to ensure stability. This in turn would imply a much slower settling time for the entire loop and the output voltage and consequently the light sources current. It should be noted that the settling time of the loop may not have a great impact in the light quality if the same current is used for the same subframe for each of the color since the previously determined value can be store in a memory and recalled once the frame presents itself again. The loop will need to track only variations in temperature and aging of the LED (light source) which are very slow variations with time. Also in practical terms since a DC-DC converter may exhibit at its output ripples in the waveforms due to the nature of operation of the converter (packet of charges delivered to the output at the frequency of operation of the clock of the converter), even with a fast digital filter there is a risk of instability because of this ripple.

Figure 8:
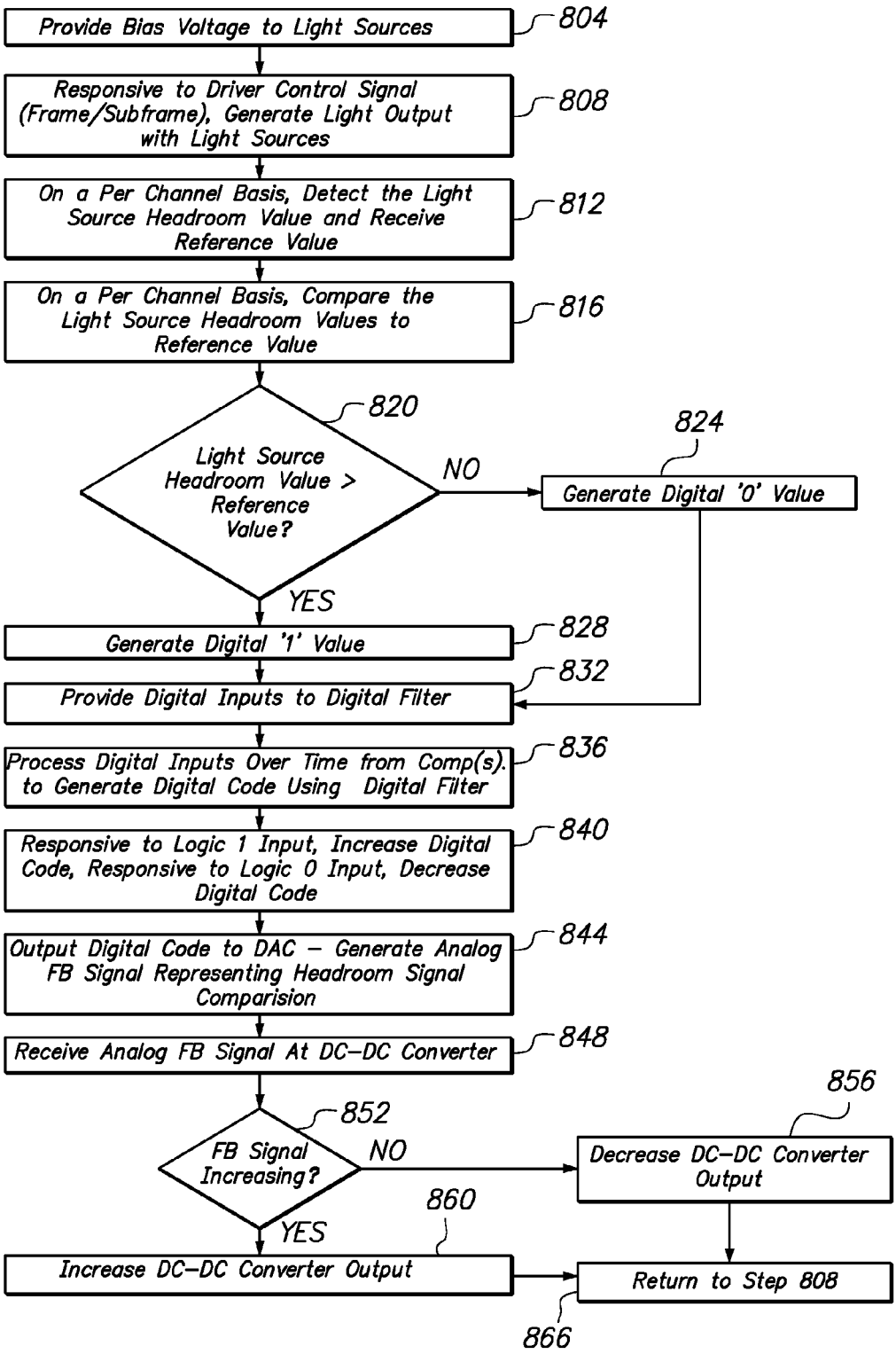
FIG. 8 illustrates an operational flow for an example method of operation for the system shown in FIG. 7.

FIG. 8 illustrates an operational flow for an example method of operation for the system shown in FIG. 7. This is one possible method of operation and one of ordinary skill in the art may develop other methods of operation without departing from the claims that follow. This method of operation establishes the headroom for every light source or channel at the reference value for that channel to establish sufficient bias or supply voltage for each light source.

At a step 804 the operation provides a bias voltage to a light source. It is preferred that this bias voltage be sufficient in magnitude to achieve light emission from the light source, particularly in a color mixing environment such that during a subframe, more than one light source is on. At a step 808, responsive to a driver control signal provided to a driver and for each frame or subframe of a projected image, the driver establishes a current through the light source according to a brightness level as set by the driver control signal. The brightness level may be established by a projection control system which sets the brightness level based on a predetermined brightness or based on a brightness level for a particular frame or subframe. As a result, the light sources output or emit light.

At a step 812, each comparator detects or receives a headroom value from the headroom node associate with each channel. Also at step 812, the comparator for each channel receives a reference value associated with each channel. The reference value may be stored in a memory, register, or established with a voltage divider network, passive element network, or active element network.

Next, at a step 816, the system, such as the comparator, compares each light source headroom value to the corresponding reference value for that channel. At decision step 820, the system, such as the digital filter determines if any comparator output is a low logic value or a '0'. If the comparison at decision step 820 determines that the headroom value is less than the reference value, then the operation advances to a step 824 and the comparator generates and outputs a low or '0' logic value. At step 832 the low logic level value or '0' (digital input) is provided to the digital filter.

Alternatively, if the comparison at decision step 520 determines that the headroom value is not less than the reference value, then the operation advances to a step 828 and the comparator generates a high logic value, such as a '1' value, and at step 832 provides the high logic value to the digital filter. These inputs to the digital filter comprise the digital inputs.

Then at a step 836 the digital filter processes the digital inputs from the comparators over time to generate a digital code. In one embodiment, the digital code output by the digital filter represents a running total or summation of the comparator values subject to the processing rule at step 840. In another embodiment, the digital code is a snapshot or representation of only the present state of the comparator outputs. In one embodiment the digital filter updates its output in response to every input from the comparators. This provides the fast response time between a change in the comparator value and the output of the digital filter. In another embodiment the output of the digital filter is only updated after a fixed number of inputs from the comparator or a fixed time period. In this manner, the digital filter may operate as a counter. For example, a '0' input decrements the counter output value while a '1' input increments the counter value but the output value of the counter is only incremented or decremented when the internal count of the counter reaches a predetermined level.

Step 840 defines the digital filter operation such that responsive to all logic 1 inputs, decreasing the digital code output by the digital filter but in response to any logic 0 input, increasing the digital code output by the digital filter. Thus, if any zero are presented to the digital filter, then the resulting digital code is increased.

At a step 844 and ongoing during operation, the digital code is presented to the DAC which generates an analog feedback signal representing the headroom value from a headroom node in relation to the headroom reference value. The feedback signal controls the DC-DC converter to increase of decrease the supply or bias voltage.

At a step 848 the DC-DC converter receives the analog feedback signal. At a decision step 852 the DC-DC converter determines if the feedback signal is increasing or decreasing or compares the feedback signal to a reference voltage within the DC-DC converter. Although shown as a decision step, because in this embodiment the DC-DC converter is an analog system the processing of the feedback signal and corresponding adjustment to the DC-DC converter output voltage occurs continuously and automatically. In this method is executed in a digital implementation, which is another possibility, then a formal decision may occur regarding whether to increase or decrease the DC-DC converter output. If the feedback signal is increasing or less than the DC-DC converter reference voltage (see FIG. 2B), then the operation advances to step 860 and the DC-DC converter increases its output voltage thereby increasing the bias or supply voltage. Alternatively, if the feedback signal is decreasing or greater than the reference voltage of the DC-DC converter, then the operation advances to step 856 and the DC-DC converter decreases its output voltage thereby decreasing the bias or supply voltage. After step 856 and step 860 the operation advances to step 866 wherein the operation returns to step 808 and the process continues to generate a still or projected image (or any other use of the color mixed light output).

Figure 9:
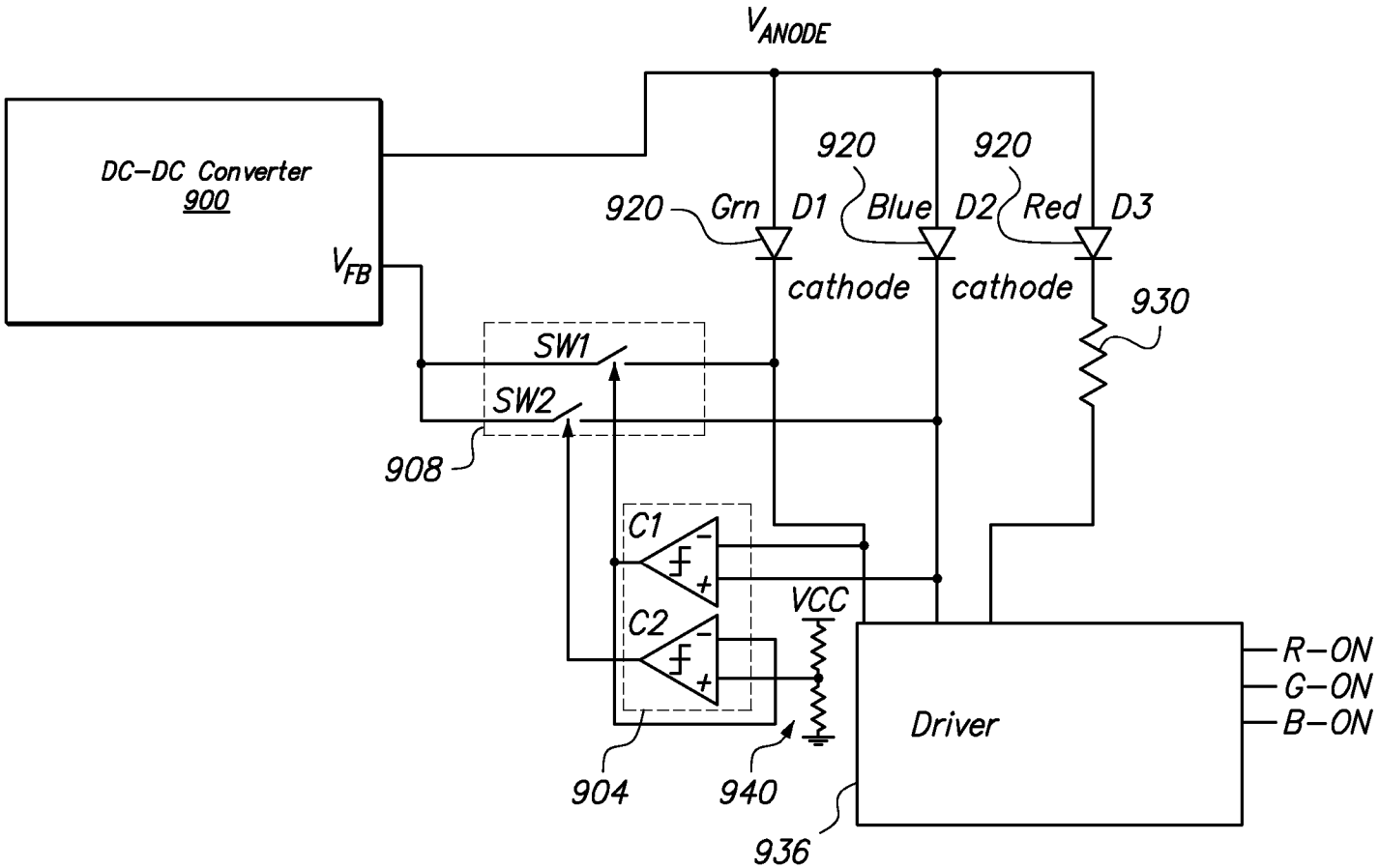
FIG. 9 illustrates is a block diagram illustrating an example embodiment of a single converter color mixing and/or de-saturation system.

FIG. 9 illustrates an example projection system which directly compares cathode voltages. This embodiment is one example implementation of the generalized block diagram of the embodiment shown in FIG. 2A. Other specific implementations of the generalized embodiment shown in FIG. 2A are possible and such implementations would not depart from the claims that follow. In this example embodiment the light sources comprise light emitting diodes D1, D2, D3, 920 but in other embodiments any type and number of light sources may be utilized. The diodes D1, D2, D3 920 are biased by a Vanodeo voltage which is sourced from a DC-DC converter 900. In other embodiments, voltage sources other than a DC-DC converter may be used.

The outputs of the diodes D1, D2, D3 920 connect to drivers 936 which are shown collectively in a single unit. A resistor 930 is optionally provided to reduce thermal stress in the case that the voltage drop of that LED is significantly lower then the others. The drivers 936 receive a control input, which may be in the form of a signal that turns on a light source to a specific output brightness. In this embodiment the control signals comprise R-ON, G-ON, and B-ON such that each signal corresponds to a red, green and blue diode output. In other embodiments, other types of light sources may be utilized. To achieve desired operation of the drivers 936 and diodes 920, sufficient voltage must be present between the diodes and the drivers for the drivers to generate or pull the amount of current to turn on the diodes, i.e. generate light. This value or voltage at the cathode terminal of the diode 920 is the headroom value or headroom voltage.

Also part of this embodiment are switches 908, and in particular switch SW1 between the cathode side of the diode D1 and the converter 900 and a switch SW2 between the cathode side of the diode D2 and the converter 900. In other embodiments, additional switches may be provided including a switch connected between the diode D3 and the converter 100. In addition, the principles of this embodiment may be expanded to monitor an additional number of channels and additional channels may be added to the system.

The switches 908 receive switch control signals from comparators 904. Comparators 904 include comparator C1 and comparator C2. The comparator C1 receives as inputs the signal on the cathode side of the diodes D1 and D2 920. Diode D1 connects to the negative input of comparator C1 while diode D2 connects to the positive input of comparator C1. Comparator C1 output controls switch SW1. Comparator C2 has a negative input connected to the output of comparator C1 and a positive input connected to a resistive network 940 established between Vcc and ground. In this embodiment, the input to the positive terminal of comparator C2 is 50% of Vcc. The output of comparator C2 controls the switch SW2. The comparator C2 may comprise an inverter as discussed below in greater detail. In this embodiment the comparator C2 was implemented as a comparator to allow the system to be small in size and by using a single part having two comparators 904, less expensive that a separate comparator and inverter. However, the output of the comparator C1 may be inverted and provided to switch SW2.

In operation the DC-DC converter 900 provides the bias as Vanode to all of the diodes D1, D2, D3 920. It is contemplated that each of the different diodes 920, which may output a different color of light, may require a different bias voltage for operation. Stated another way, diodes of different color, different design, or different manufacturing lots typically have a different threshold or turn-on voltage required to emit light output. In the example embodiment show in FIG. 9, the red light emitting diode has a lower turn-on voltage than the other diodes of different color so if the bias voltage (Vanode) for the other two diodes is of sufficiently magnitude to enable light output, then the bias voltage will also be of sufficient magnitude to turn on the red diode. For this reason, a resistor (discussed below) is provided in the red channel to reduce thermal stress.

To reduce power consumption while maintaining desired biasing, the biasing established by the DC-DC converter 900 is varied over time to match the biasing requirements for the diode in operation, and such diodes may be time multiplexed, on a frame by frame or subframe by subframe basis, to generate the three color channels for the image or video. In addition, over time or across different manufacturers or manufacturing process the required bias voltage for a light source may vary.

The switches 908 are configured to receive the voltage on one of the cathode terminals of the diode 920 and in turn pass that input (headroom value) to the converter 900 so that the converter can generate and provide the desired and required bias Vanode which achieves sufficient threshold or turn-on voltage for each diode. Selectively controlling which switch SW1, SW2 908 is closed and open will control the input (headroom value) that is provided to the converter 900. For example, if switch SW1 is closed, then the voltage at the cathode side of diode D1 is presented to the converter 900, and the converter 900 processes that voltage to determine or insure that the desired and required bias voltage Vanode is presented from the converter 900 to the diodes 920. In one embodiment the converter 900 sets the Vanode voltage based on an in direct relation to a cathode voltage, or based on a stored and predetermined value, such a reference value or reference voltage. In one embodiment the switch 908 that is closed is the switch that corresponds to the diode 920 having a cathode voltage that is the smallest. Thus, in one embodiment for the system to operate, the lowest voltage is provided to the DC-DC converter 900 which forces the system to set Vanode at a level that establishes sufficient Vanode voltage to turn on all the diodes 920 that should be on according to the control signals provided to the drivers 936.

Therefore, to allow the other diodes 920 to turn on during diode D3's period (subframe) for image generation, there must be sufficient voltage Vanode to bias diodes D1 and D2. In addition, either of diode D1 or diode D2 may require a higher bias voltage Vanode and which of diode D1 or diode D2 requires the higher bias voltage may change during operation based any number of factors such as age, temperature, current, or other factors. Likewise, when expanded to monitor the 3$^{rd}$ channel, or any number of additional channels, this analysis must also consider the required bias voltage for the other diodes (light sources) for the other channels. Failure to sufficiently set the bias voltage for the diode 920 that requires the higher or highest bias voltage will result in that diode not emitting light, a possible color shift, and image quality will suffer.

To achieve these operation parameters, the comparator C1 compares the cathode side voltage of diodes D1 and D2, which are provided as inputs to the comparator C1. If the voltage on the cathode side of diode D1 is less then the voltage on the cathode side of diode D2, then the output of the comparator C1 is high and this results in switch SW1 being closed. As a result, the comparator C2 forces the switch SW2 open. The converter 900 thus sets the bias voltage Vanode based on the diode D1 biasing requirements. Whether these biasing requirements are met is determined by detecting and comparing the cathode voltage at the cathode terminal of diode D1 to the cathode voltage at the cathode terminal of diode D2. In other embodiments, the comparison to the cathode voltage occurs in relation to a reference value.

If cathode voltage of diode D2 is less than the cathode voltage of diode D1, then the output of comparator C1 is low and this forces the switch SW1 open and comparator C2 closes switch SW2. This sets the bias voltage Vanode based on the diode D2 biasing requirements which is based on the cathode voltage.

With regard to comparator C2, it receives as an input the output from comparator C1 and a second input in this embodiment 50% of Vcc. In operation, it acts as an inverter or a 'not' gate of the output of comparator C1. Use of 50% of Vcc provides a generally constant and defined threshold or comparator value which is typically midway between the high or low output of comparator C1.

This combination of the switches 908 and the comparators 904 detect which anode voltage is the lesser of the two detected and responsive thereto controls switches to connect the proper cathode voltage of diode D1 920 or diode D2 to the converter 900. As a result, the converter 900 establishes the bias voltage sufficiently high for the requirements of the particular light source (D1, D2) 920 which requires the higher bias voltage, without wasting power.

This arrangement is shown in relation to diode D1 and diode D2 because the voltage biasing requirements for diode D3 red is typically less (lower voltage drop across a reed diode D3) than green diode D1 and blue diode D2. However, it is contemplated that this arrangement of comparators 904, switches 908 and interconnects may be applied to any diode 920 or any number or type of light sources.

Figure 10:
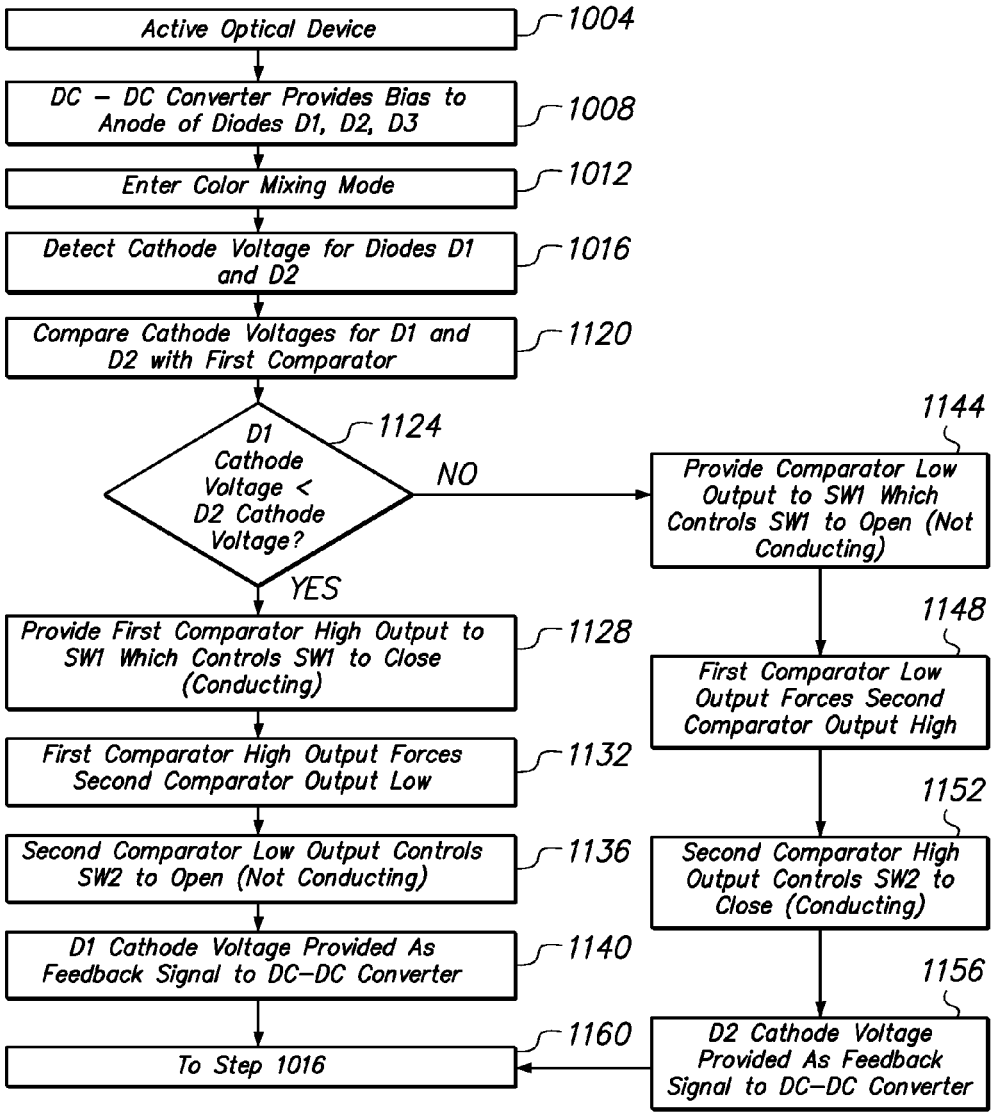
FIG. 10 illustrates an operational flow diagram of an exemplary method of operation of the system shown in of FIG. 9.

FIG. 10 illustrates an operational flow diagram of an exemplary method of operation of the system shown in of FIG. 9. This is but one possible method of operation and as such it is contemplated that one of ordinary skill in the art may generate alternative methods of operation which do not depart from the claims. This embodiment is in contemplation of a color mixing environment where more than one light source is on at a particular time to create increased brightness. In other embodiment, color mixing may not occur. This method may be expanded to cover additional channels and the monitoring of additional channels.

In reference to FIG. 10, at a step 1004 the system activates the optical device. This may comprise turning on the optical device or activating a projection or imaging system. Although this embodiment is shown in a step by step flow chart as may be associated with a processor or software driven system, the method of FIG. 10 may be implemented in an analog or digital implementation. When implemented in an analog system as shown in FIG. 9, the operation occurs automatically and dynamically in real time and not necessarily in the step wise manner suggested in a flow chart. The bias signal is continuously monitored and updated based on the feedback loop.

At a step 1008 the DC-DC converter provides a bias signal to an anode of the diodes D1, D2, D3 as shown in FIG. 9. Light output from the diodes is controlled by the driver control signals (R_ON, G_ON and B_ON) and at a step 1012 the system enters color mixing mode such that more than one diode (light source) is on at a time. This increases brightness but requires that adequate biasing be provided for all the light sources which are 'on'.

During operation and at a step 1016, the cathode voltage for diodes D1 and D2 are detected or provided to the comparators. Comparators may perform this detecting through a connection to the cathode node of one or more diodes. At a step 1120, the operation compares the detected cathode voltages for D1 and D2 with the first comparator. In other embodiments the comparison occurs between a cathode voltage and reference value.

At a decision step 1124 the operation determines if diode D1 cathode voltage is less than the diode D2 cathode voltage. If diode D1 cathode voltage is less than the diode D2 cathode voltage, then the operation advances to step 1128 and the first comparator C1 generates a logic high output which is provided to the first switch SW1. This forces the switch SW1 to close to form a conducting state which connects cathode voltage of diode D1 as a feedback signal to the DC-DC converter.

At a step 1132, the high logic level output from the first comparator C1 is provided as an input to the second comparator C2 which forces the output of the second comparator low. At a step 1136 the second comparator low output is provided to the second switch SW2 thereby forcing the second switch to an open non-conducting condition. This results in only the diode D1 cathode voltage being provided as a feedback signal to the DC-DC converter at a step 1140. In response, the DC-DC converter increases or decreases the anode voltage to a level that maximizes efficiency while also insuring that all active light sources (diodes) are biased sufficiently to output a brightness level requested by the driver based on the driver control signal.

Alternatively, if at decision step 1124 the diode D1 cathode voltage is not less than the diode D2 cathode voltage, then the operation advances to step 1144 and the first comparator C1 generates a logic low output which is provided to the first switch SW1. This forces switch SW1 to open to form a non-conducting condition which results in the cathode voltage for diode D1 not being connected to the DC-DC converter. Hence, cathode voltage for diode D1 is not the feedback signal.

At a step 1148, the low logic level output from the first comparator C1 is provided as an input to the second comparator C2 which forces the output of the second comparator high. At a step 1152 the second comparator high output is provided to the second switch SW2 thereby forcing the second switch to a closed conducting condition. This results in only the diode D2 cathode voltage being provided as a feedback signal to the DC-DC converter at a step 1156. In response, the DC-DC converter increases or decreases the anode voltage to a level that maximizes efficiency while also insuring that all active light sources (diodes) are biased sufficiently to output a brightness level requested by the driver based on the driver control signal.

By selectively controlling which cathode voltage is provided to the DC-DC converter as the feedback signal, the anode voltage (bias signal) is based on the smaller of the two detected cathode voltages. In reference to FIG. 2B, the feedback signal may be compared to a reference voltage within the DC-DC converter which results in a error signal comprising the difference between the feedback signal (cathode voltage or headroom signal) and the DC-DC converter reference voltage. This error signal modifies the magnitude of the anode voltage. At a step 1060 the operation returns to step 1016.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A light source bias control system with a single converter comprising:

a first light source having an associated first headroom value on a first terminal;

a second light source having an associated second headroom value on a second terminal;

one converter configured to bias the first light source and the second light source;

a switch, responsive to a switch control signal, capable of establishing:

a first feedback path between the first terminal and the converter; and a second feedback path between the second terminal and the converter;

at least one comparator configured to:

receive and compare the first headroom value to a first reference value to generate a first comparator output;

receive and compare the second headroom value to a second reference value to generate a second comparator output;

a digital filter and digital to analog converter between the switch and the converter; and control logic configured to process the first comparator output and the second comparator output to generate the switch control signal.

2. The system of claim 1 wherein the first light source and the second light source comprise light emitting diodes.

3. The system of claim 1 wherein the control logic comprises a state machine.

4. The system of claim 1 wherein the converter comprises a DC-DC converter.

5. The system of claim 1 wherein the first source emits a different color light than the second light source and there are a greater number of light sources than converters.

6. The system of claim 1 further comprising an analog feedback loop between the switch and converter.

7. The system of claim 1 further comprising a digital filter and digital to analog converter between the switch and the converter.

8. A method for biasing two or more light sources comprising:

generating a bias signal with a bias signal generator;

providing the bias signal having a first magnitude from a bias signal generator to a first light source and a second light source which establishes a first light source cathode voltage and a second light source cathode voltage;

comparing the first light source cathode voltage to the second light source cathode voltage or to a reference voltage to generate comparator outputs, the comparing including:

processing the comparator outputs with a digital filter to generate a digital feedback signal converting the digital feedback signal to an analog feedback signal;

presenting the analog feedback signal to the bias signal generator;

responsive to the comparing, generating one or more switch control signals;

providing the one or more switch control signals to a switch to present the bias signal generator with a feedback signal or a proportional representation of the feedback signal; and responsive to the feedback signal or a proportional representation of the feedback signal generating a bias signal having a second magnitude different the first magnitude with the bias signal generator.

9. The method of claim 8 wherein the bias signal having a second magnitude corresponds to a biasing level for the light source having the highest threshold voltage.

10. The method of claim 8 wherein the light source comprises a diode.

11. The method of claim 8 wherein the bias signal generator comprises a DC-DC converter.

12. The method of claim 8 wherein the feedback signal comprises a cathode voltage.

13. The method of claim 12 wherein the smaller of the first light source cathode voltage and the second light source cathode voltage is output from the switch.

14. The method of claim 8 wherein comparing the first light source cathode voltage to the second light source cathode voltage or to a reference voltage generates comparator outputs and further comprising:

processing the comparator outputs with a digital filter to generate a digital feedback signal converting the digital feedback signal to an analog feedback signal;

presenting the analog feedback signal to the bias signal generator.

15. A system having two or more light sources configured to generate a color mixed optical signal output comprising:

one or more bias signal sources configured to generate a bias signal, the bias signal set by a feedback signal there being a fewer number of bias signal sources than light sources;

two or more channels, wherein each channel comprises:

a light source having a bias set by the bias signal and a light source headroom value associated with each light source;

a driver connected to the light source which is responsive to a control signal to establish a current through the light source to generate an optical output signal;

a comparator configured to compare the headroom value to a reference value to generate a comparator output;

a controller configured to receive the comparator output from one or more channels to generate feedback signal to the one or more bias sources, the controller including a digital filter configured to receive the comparator output for at least two channels and generate a digital code; and a digital to analog converter configured to convert the digital code to a analog signal which establishes the feedback signal.

16. The system of claim 15 wherein the controller comprises a digital filter configured to receive the comparator output for at least two channels and generate a digital code;

a digital to analog converter configured to convert the digital code to a analog signal which establishes the feedback signal.

17. The system of claim 16 wherein the digital filter comprises an up-down counter configured to generate an output that increases in response to a high logic value and decreases in response to a low logic value.

18. The system of claim 15 wherein the comparator output is high if the headroom value is greater than the reference value.

19. The system of claim 15 wherein the headroom value comprises the difference between the bias signal and the turn on voltage for the light source.

20. The system of claim 15 wherein the controller comprises a channel selector and a switch such that channel selector generates a switch control signal to control the switch to provide one of the light source headroom values or a signal proportional to one of the light source headroom signals to the bias signal generator as the feedback signal.

21. The system of claim 20 wherein the channel selector comprises control logic, a state machine, or both.

22. The system of claim 15 further comprising an analog feedback loop between the controller and at least one bias signal source.

* * * * *